US009708740B2

(12) United States Patent
Bae et al.

(10) Patent No.: US 9,708,740 B2
(45) Date of Patent: Jul. 18, 2017

(54) BALANCER, BALANCER HOUSING, WASHING MACHINE HAVING THE SAME AND CONTROL METHOD THEREOF

(71) Applicant: SAMSUNG ELECTRONICS CO., LTD., Suwon-si (KR)

(72) Inventors: Il Sung Bae, Yongin-si (KR); Myung Chul Kim, Yongin-si (KR); Moo Hyung Lee, Seoul (KR); Jae Seuk Park, Yongin-si (KR); Sung Jin Cho, Yongin-si (KR); Kwan Joo Myoung, Suwon-si (KR); Se Jin Jo, Gunpo-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1010 days.

(21) Appl. No.: 13/910,465

(22) Filed: Jun. 5, 2013

(65) Prior Publication Data

US 2013/0327098 A1 Dec. 12, 2013

(30) Foreign Application Priority Data

Jun. 7, 2012 (KR) ..... 10-2012-0061185
Nov. 6, 2012 (KR) ..... 10-2012-0124573

(51) Int. Cl.
*D06F 37/22* (2006.01)
*D06F 37/20* (2006.01)

(52) U.S. Cl.
CPC ..... *D06F 37/203* (2013.01); *D06F 37/225* (2013.01); *Y10T 74/2109* (2015.01)

(58) Field of Classification Search
CPC ..... D06F 37/225; D06F 37/203; D06F 33/02; D06F 33/245; Y10T 74/2109
(Continued)

(56) References Cited

U.S. PATENT DOCUMENTS 2,610,523 A * 9/1952 Kahn ..... D06F 37/225 210/144
3,371,450 A * 3/1968 Board, Jr. ..... B24B 41/04 451/343

(Continued)

FOREIGN PATENT DOCUMENTS

EP 2 441 872 4/2012
JP 2000-50679 2/2000

(Continued)

OTHER PUBLICATIONS

Ida, Doshu et al., "Spin-drying Washing Machine" Jan. 2005, JP 2005-021505—Machine Translation.*

(Continued)

*Primary Examiner* — David Cormier
*Assistant Examiner* — Thomas Bucci
(74) *Attorney, Agent, or Firm* — Staas & Halsey LLP

(57) ABSTRACT

A washing machine having a balancer housing capable of transmitting electric power from an external power source to a balancing module. The washing machine includes a rotary drum, and a balancer to counterbalance an unbalanced load generated in the rotary drum. The balancer includes a balancer housing mounted to the rotary drum, and a balancing module having a moving unit to move inside the balancer housing. The balancer housing includes an electrode provided at an inner surface of the balancer housing in a circumferential direction thereof in order to transmit electric power to the moving unit of the balancing module, an electric wire electrically connected to the electrode in order to apply electric power from an external power source to the electrode, and a connector provided at an outer surface of the balancer housing in order to electrically connect the electric wire and the electrode.

33 Claims, 21 Drawing Sheets

(58) Field of Classification Search
USPC ..... 68/23.2, 12.06, 140, 139, 23, 1, 12.02, 68/3 R, 24, 23.3, 12.01, 12.16, 142; 74/572.4, 570.2, 571.1, 574.2, 574.1, 74/572.1, 572.11, 573.1; 8/137, 159, 158, 8/147; 210/144, 363, 360.1, 364, 368; 439/660, 676, 271, 346
See application file for complete search history.

(56) References Cited

U.S. PATENT DOCUMENTS

| | | | | |
|---|---|---|---|---|
| 5,813,253 | A | 9/1998 | Uhlin | |
| 6,210,099 | B1 * | 4/2001 | Hugbart | F16F 15/36 415/119 |
| 7,059,901 | B2 * | 6/2006 | Morita | H01R 13/645 439/271 |
| 2012/0084926 | A1 * | 4/2012 | Lee | D06F 37/225 8/137 |
| 2012/0144881 | A1 * | 6/2012 | Farid | D06F 37/225 68/200 |
| 2012/0192362 | A1 * | 8/2012 | Lee | D06F 37/203 8/137 |

FOREIGN PATENT DOCUMENTS

| | | | |
|---|---|---|---|
| JP | 2005-21505 | | 1/2005 |
| JP | 2005021505 | A * | 1/2005 |
| KR | 1995-0018902 | | 7/1995 |
| KR | 1996-0032003 | | 9/1996 |
| KR | 2003-0089094 | | 11/2003 |
| KR | 10-2006-0088720 | | 8/2006 |
| KR | 10-2011-0010945 | | 2/2011 |
| WO | WO 2010/133480 | | 11/2010 |
| WO | WO 2011/115384 | | 9/2011 |

OTHER PUBLICATIONS

International Search Report mailed Aug. 23, 2013 in corresponding International Application No. PCT/KR2013/004943.
European Search Report mailed Oct. 7, 2013 in corresponding European Application No. 13170887.7.
Canadian Notice of Allowance dated Aug. 18, 2016 in corresponding Canadian Patent Application No. 2,875,648.
Chinese Notice of Allowance dated Sep. 13, 2016 in corresponding Chinese Patent Application No. 201310225275.0.
European Intention to Grant dated Oct. 10, 2016 in corresponding Canadian Patent Application No. 14 199 070.5.

* cited by examiner

BALANCER, BALANCER HOUSING, WASHING MACHINE HAVING THE SAME AND CONTROL METHOD THEREOF

CROSS-REFERENCE TO RELATED APPLICATIONS

This application claims the priority benefit of Korean Patent Application Nos. 10-2012-0061185 and 10-2012-0124573, filed on Jun. 7, 2012 and Nov. 6, 2012, respectively, in the Korean Intellectual Property Office, the disclosure of which is incorporated herein by reference.

BACKGROUND

1. Field

Embodiments of the present disclosure relate to a balancer having a balancer housing capable of supplying electric power to a balancing module to counterbalance an unbalanced load, a washing machine and a control method thereof to diagnose a malfunction of the balancer.

2. Description of the Related Art

A washing machine is an appliance that washes laundry using electric power. In general, a washing machine comprises a tub to store wash water, a rotary drum rotatably mounted in the tub, and a motor to rotate the rotary drum.

The washing machine performs a series of processes such as washing, rinsing and dehydration process using rotational movement of the rotary drum.

When the rotary drum rotates, if laundry is not evenly distributed in the rotary drum but accumulates at one side of the rotary drum, vibration and noise may occur due to eccentric rotation of the rotary drum, and components such as the rotary drum, the motor or the like may be damaged.

Accordingly, the washing machine is equipped with a balancer in order to stabilize rotation of the rotary drum by counterbalancing an unbalanced load generated in the rotary drum.

Recently, a balancer capable of actively moving to a position counterbalancing an unbalanced load and a structure capable of transmitting external electric power to such a movable balancer have been developed.

SUMMARY

It is an aspect of the present disclosure to provide a washing machine equipped with a balancer housing capable of transmitting electric power from an external power source to a balancing module.

It is another aspect of the present disclosure to provide a washing machine and a control method thereof to diagnose a malfunction of a balancer.

Additional aspects of the disclosure will be set forth in part in the description which follows and, in part, will be apparent from the description, or may be learned by practice of the disclosure.

In accordance with an aspect of the present disclosure, a washing machine includes a rotary drum, and at least one balancer configured to counterbalance an unbalanced load generated in the rotary drum. The at least one balancer includes at least one balancer housing mounted to the rotary drum, and at least one balancing module having a moving unit to move inside the balancer housing. The balancer housing includes at least one electrode provided at an inner surface of the balancer housing in a circumferential direction of the balancer housing in order to transmit electric power to the moving unit of the balancing module, at least one electric wire electrically connected to the electrode in order to apply electric power from an external power source to the electrode, and a connector provided at an outer surface of the balancer housing in order to electrically connect the electric wire and the electrode.

The connector may include a socket protrudingly provided at the outer surface of the balancer housing, the socket being located at a position corresponding to a position of the electrode, and a plug unit configured to be coupled to the socket unit.

The plug unit may include a wire terminal to fix an end portion of the electric wire in the plug unit.

The socket unit may include a socket hole formed at a center portion thereof, into which the plug unit is inserted.

The socket unit may further include an electrode terminal to electrically connect the wire terminal and the electrode.

The connector may further include a protruding part provided at the socket unit provided outer surface of the balancer housing, the protruding part having a shape corresponding to a shape of the plug unit.

The protruding part and the plug unit may be coupled to each other by ultrasonic welding.

The plug unit may include a waterproof recess which is depressed inwardly at a portion thereof.

The waterproof recess may be filled with an epoxy resin to prevent water from passing through the plug unit.

The electrode may be formed by coating a conductive film on the inner surface of the balancer housing.

The washing machine may further include at least one lifter protrudingly provided at an inner circumferential surface of the rotary drum.

The lifter may have an end portion which is in contact with the balancer.

The connector may pass through the end portion of the lifter.

The electric wire may have an end portion connected to the connector, and may pass through the lifter.

In accordance with another aspect of the present disclosure, a washing machine includes a rotary drum in which laundry is placed, the rotary drum being capable of rotating by a driving source, at least one balancer housing mounted to the rotary drum, and at least one lifter mounted to an inner circumferential surface of the rotary drum. The balancer housing includes at least one electric wire electrically connected to the balancer housing, and a connector provided at an outer surface of the balancer housing in order to electrically connect the electric wire and the balancer housing. The electric wire passes through the lifter.

The connector may pass through an end portion of the lifter, and may be insertedly disposed in the lifter.

The washing machine may further include a flange disposed at the rear portion of the rotary drum and coupled to a driving shaft which enables the rotary drum to rotate.

The electric wire passing through the lifter may extend along the flange.

In accordance with a further aspect of the present disclosure, a washing machine includes a rotary drum in which laundry is placed, the rotary drum being capable of rotating by a driving source, a flange mounted to a rear surface of the rotary drum and coupled to a driving shaft which enables the rotary drum to rotate, and a balancer housing disposed at the rear portion of the flange. The balancer housing includes at least one electric wire electrically connected to the balancer housing, and a connector provided at an outer surface of the balancer housing in order to electrically connect the electric wire and the balancer housing. The electric wire may include one end portion connected to the connector, and the other end portion extending along the flange and passing through the driving shaft.

The driving shaft may be formed in a hollow cylindrical shape, through which the electric wire passes.

In accordance with a further aspect of the present disclosure, a balancer mounted to a rotary drum to counterbalance an unbalanced load generated in rotation of the rotary drum, includes at least one balancing module configured to move to a position capable of counterbalancing the unbalanced load of the rotary drum, and a balancer housing formed with a ring-shaped channel therein along which the balancing module moves. The balancer housing includes at least one electrode provided at an inner surface of the balancer housing in a circumferential direction of the balancer housing, and a connector provided at an outer surface of the balancer housing in order to electrically connect an external power source and the electrode.

The connector may include a socket unit protrudingly provided at the outer surface of the balancer housing, the socket unit being located corresponding to a position of the electrode, and a plug unit configured to be coupled to the socket unit.

In accordance with a further aspect of the present disclosure, a balancer housing of a balancer configured to counterbalance an unbalanced load generated in rotation of a rotary drum, includes at least one electrode provided at an inner surface of the balancer housing in a circumferential direction of the balancer housing in order to supply electric power to the balancer, a socket unit protrudingly provided at an outer surface of the balancer housing, and a plug unit configured to be coupled to the socket unit in order to apply external electric power to the electrode.

The socket unit may include a socket hole formed at a center portion thereof, into which the plug unit is inserted.

The plug unit may be inserted into the socket hole, and may be electrically connected to the electrode.

In accordance with a further aspect of the present disclosure, a washing machine includes a rotary drum, a balancer to counterbalance an unbalanced load generated in the rotary drum, the balancer including at least one balancer housing mounted to the rotary drum, and a balancing module having a movement motor which enables the balancing module to move inside the balancer housing, a power supply unit to supply electric power to the balancer, a detection unit to detect at least one signal of electric current and voltage of the electric power applied from the power supply unit to the balancer, and a control unit to determine whether the intensity of the detected signal is within a normal range and determine that the balancer malfunctions upon determining that the intensity of the detected signal is outside the normal range.

The washing machine may further include a driving unit to drive the movement motor of the balancing module, and the control unit may stop driving of the movement motor upon determining that the balancer malfunctions.

The balancer may further include a connector connected to an external power source to receive electric power from the external power source, at least two electrodes provided at the balancer housing to receive electric power from the connector, the electrodes having different polarities from each other, and at least two brushes provided at the balancing module and configured to be respectively in contact with the at least two electrodes to receive the electric power.

The control unit may determine whether the detected voltage is within a normal range, and may determine whether there is poor contact between the connector and the electrodes or poor contact of at least one contact point between the electrodes and the brushes.

The control unit may determine whether the detected electric current is within a normal range, and may determine whether there is poor contact between the connector and the electrodes or poor contact of at least one contact point between the electrodes and the brushes.

The washing machine may further include a wash motor to apply rotational force to the rotary drum, and an unbalance detection unit to detect the amount of unbalance in rotation of the wash motor. The control unit may control a position and a speed of the movement motor based on the detected amount of unbalance.

The detection unit may include a speed detection unit to detect the speed of the movement motor, and the control unit may adjust the speed of the movement motor based on the detected speed.

The power supply unit may include a slip ring in which electric current generated by rotation of the wash motor is induced.

In accordance with a further aspect of the present disclosure, a control method of a washing machine includes if electric power is supplied to a balancer mounted to a rotary drum, detecting an electric signal of the electric power supplied to the balancer, determining whether the balancer malfunctions based on the detected electric signal, outputting a malfunction signal of the balancer upon determining that the balancer malfunctions, and stopping driving of a balancing module provided at the balancer.

The supplying the electric power to the balancer may include receiving the electric power from an external power source using a connector mounted to a balancer housing, transmitting the electric power supplied to the connector to two electrodes having different polarities provided at the balancer housing, and receiving the electric power transmitted to the two electrodes through two brushes provided at the balancing module.

The determining whether the balancer malfunctions based on the detected electric signal may include detecting voltage of a power supply unit, and determining whether there is poor contact between the connector and the electrodes or poor contact of at least one contact point between the electrodes and the brushes by comparing the detected voltage with reference voltage within a normal range.

The determining whether the balancer malfunctions based on the detected electric signal may include detecting electric current of a power supply unit, and determining whether there is poor contact between the connector and the electrodes or poor contact of at least one contact point between the electrodes and the brushes by comparing the detected electric current with first reference electric current within a normal range.

The determining whether the balancer malfunctions based on the detected electric signal may further include determining whether there is a short between the two brushes by comparing the detected electric current with second reference electric current.

The determining whether the balancer malfunctions based on the detected electric signal may further include determining whether a movement motor to move the balancing module malfunctions by comparing the detected electric current with third reference electric current.

As described above, electric power from an external power source may be transmitted to the balancing module by a simple method through the electrodes of the balancer housing.

The balancer housing may have a structure capable of easily connecting the electric wires thereto and preventing wash water from passing through the balancer housing.

In addition, because a malfunction of the balancing module moving inside an enclosed space defined by the balancer housing and a malfunction of the power supply system of the balancer housing are diagnosed, a user may easily know occurrence of a malfunction of the balancer. Accordingly, a user may quickly address a malfunction of the balancer, thereby preventing other components from being negatively influenced and increasing product lifespan.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
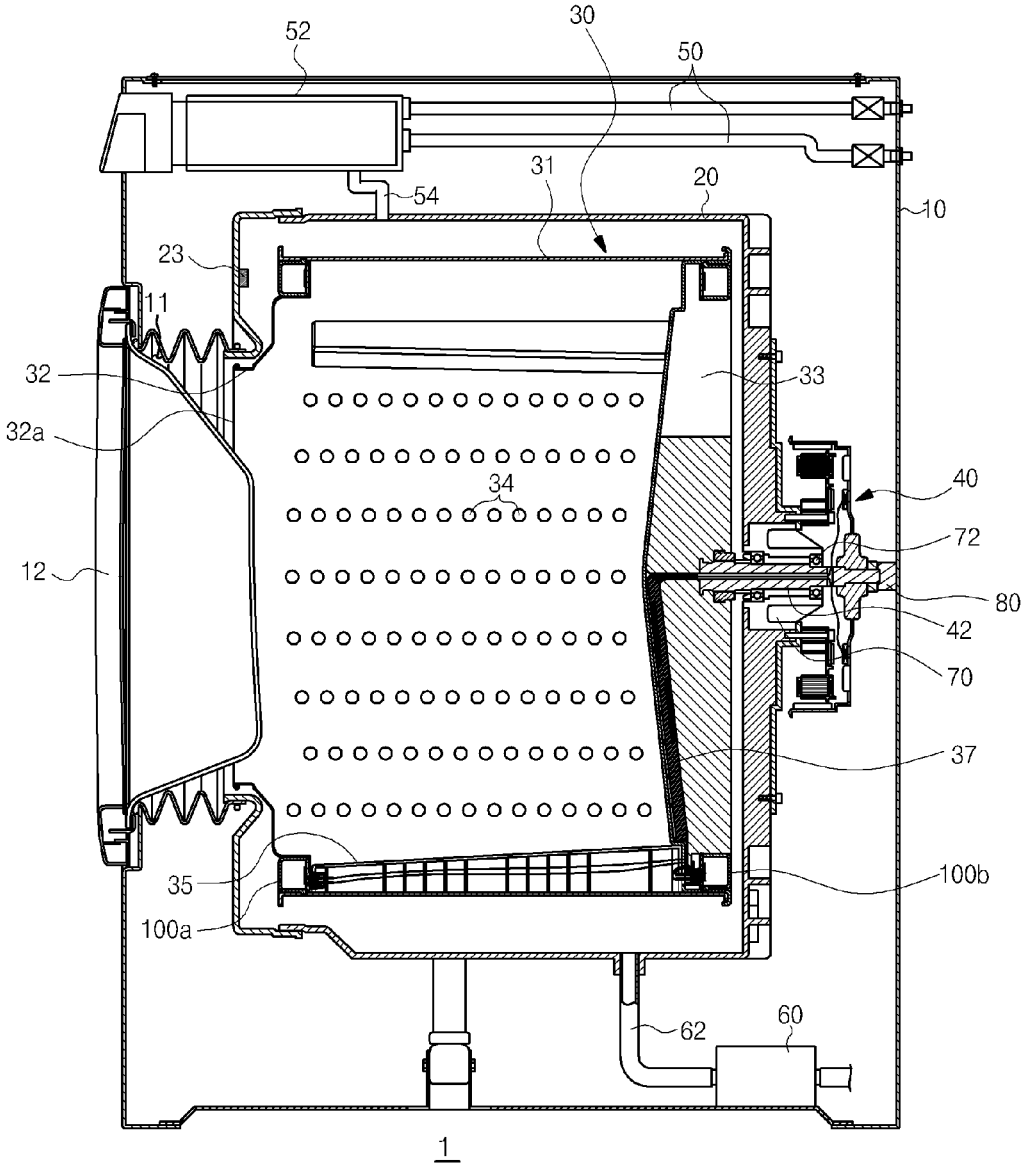
FIG. 1 is a view illustrating constitution of a washing machine according to an embodiment of the present disclosure.

Reference will now be made in detail to embodiments of the present disclosure, examples of which are illustrated in the accompanying drawings, wherein like reference numerals refer to like elements throughout.

FIG. 1 is a view illustrating constitution of a washing machine according to an embodiment of the present disclosure.

As shown in FIG. 1, a washing machine 1 comprises a cabinet 10 defining an appearance of the washing machine, a tub 20 disposed in the cabinet 10, a rotary drum 30 rotatably disposed in the tub 20, and a wash motor 40 to rotate the rotary drum 30.

In accordance with embodiments, the tub 20 may be formed integrally with the cabinet 10.

The cabinet 10 is formed with a laundry entrance hole 11 at a front portion thereof, through which a user places laundry into the rotary drum 30. A door 12 is provided at the front portion of the cabinet 10 in order to open and close the laundry entrance hole 11.

A water supply pipe 50, through which wash water is supplied to the tub 20, is mounted above the tub 20. One end portion of the water supply pipe 50 is connected to an external water supply source (not shown), and the other end portion of the water supply pipe 50 is connected to a detergent supply device 52.

The detergent supply device 52 is connected to the tub 20 by a connection pipe 54. The water supplied through the water supply pipe 50 flows into the tub 20 together with a detergent via the detergent supply device 52.

A drain pump 60 and a drain pipe 62 are mounted below the tub 20, in order to discharge the water in the tub 20 from the cabinet 10.

The rotary drum 30 includes a cylindrical body 31, a front plate 32 provided at a front portion of the cylindrical body 31, and a rear plate 33 provided at a rear portion of the cylindrical body 31. The front plate 32 is formed with an opening 32*a* through which laundry is placed or removed into/from the rotary drum 30.

The rotary drum 30 is formed with a plurality of through-holes 34 for wash water circulation on a peripheral surface thereof. The rotary drum 30 is also provided with a plurality of lifters 35 on an inner circumferential surface thereof, in order to lift laundry when the rotary drum 30 rotates.

A driving shaft 42 is mounted between the rotary drum 30 and the wash motor 40. One end portion of the driving shaft 42 is connected to the rear plate 33 of the rotary drum 30, and the other end portion of the driving shaft 42 extends outside a rear wall of the tub 20. If the wash motor 40 drives the driving shaft 42, the rotary drum 30 connected to the driving shaft 42 rotates about the driving shaft 42.

A bearing housing 70 is mounted to the rear wall of the tub 20, in order to rotatably support the driving shaft 42. The bearing housing 70 may be made of aluminum alloy, and may be inserted into the rear wall of the tub 20 in an injection molding process of the tub 20. Bearings 72 are disposed between the bearing housing 70 and the driving shaft 42 so that the driving shaft 42 may smoothly rotate.

In a washing process, the wash motor 40 rotates the rotary drum 30 at a relatively low speed in an alternating forward and reverse direction. Laundry in the rotary drum 30 repeatedly may move up and down, thereby removing contaminants from the laundry.

In a dehydration process, the wash motor 40 rotates the rotary drum 30 at a relatively high speed in one direction. Accordingly, water is separated from the laundry by centrifugal force exerted thereon.

When the rotary drum 30 rotates during the dehydration process, if the laundry is not evenly distributed in the rotary drum 30 but accumulates at one side of the rotary drum 30, rotation of the rotary drum 30 may become unstable and vibration and noise may occur.

In order to accomplish stable rotation of the rotary drum 30, the washing machine 1 includes at least one balancer 100 (100*a* and 100*b*) and a power supply unit to supply driving power to the balancer. The power supply unit may be configured as a slip ring, an electric generator or a switched mode power supply (SMPS), for example.

Hereinafter, an exemplary embodiment of using a slip ring as the power supply unit will be explained.

The wash motor 40 includes a ring-shaped stator, a rotor 40*a* rotatably disposed around the stator, a driving shaft, one end portion of which is connected to the rotor 40*a* to rotate together with the rotor 40*a*, and a slip ring 80 disposed at the rear portion of the rotor 40*a*. The rotor 40*a* is configured to rotate by electromagnetic interaction with the stator. The driving shaft is formed in a cylindrical shape with a hollow portion, through which an electric wire may pass. The slip ring 80 receives electric current generated by rotation of the rotor 40*a*.

The slip ring 80, which is coupled to a rear surface of the rotor 40*a* of the wash motor 40, includes a body 81 fixed to the rotor 40*a*, and a rotating member 82 rotatably disposed in the body 81. The rotating member 82 is connected with an electric wire 122 extending through the driving shaft 42.

The slip ring 80 receives electricity generated by rotation of the rotor 40*a*, and supplies the same to the balancer 100 through the electric wire 122.

An exemplary embodiment of using an electric generator as the power supply unit will now be briefly explained.

The washing machine may include an electric generator mounted to the rotor of the wash motor.

If electric current flows through a stator coil of the wash motor, a magnetic field is generated. The rotor may rotate by the magnetic field generated from the stator coil and a magnetic field of a rotor magnet.

In relative relation between the magnet of the generator and the coil of the generator, if the rotor rotates, the magnetic flux applied to the coil from the magnet changes, and electric current flows through the coil of the generator.

According to such an operational principle, the rotor rotates, and electricity is generated from the coil of the electric generator.

That is, rotation of the driving shaft drives the electric generator coupled to the rotor of the wash motor, thereby generating electricity through the electric generator.

Figure 2A:
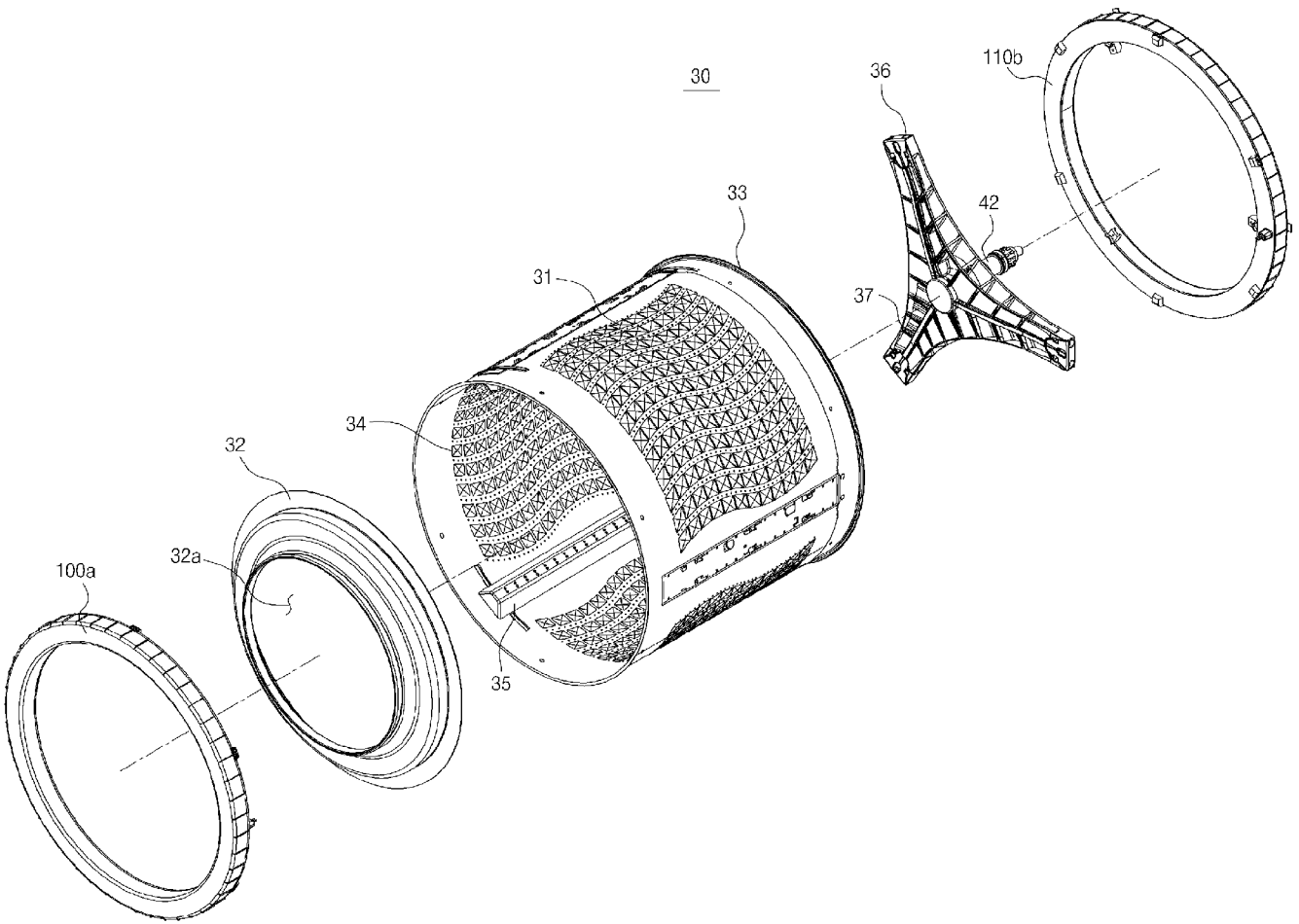
FIG. 2A is an exploded perspective view of a rotary drum of the washing machine depicted in FIG. 1.
Figure 2B:
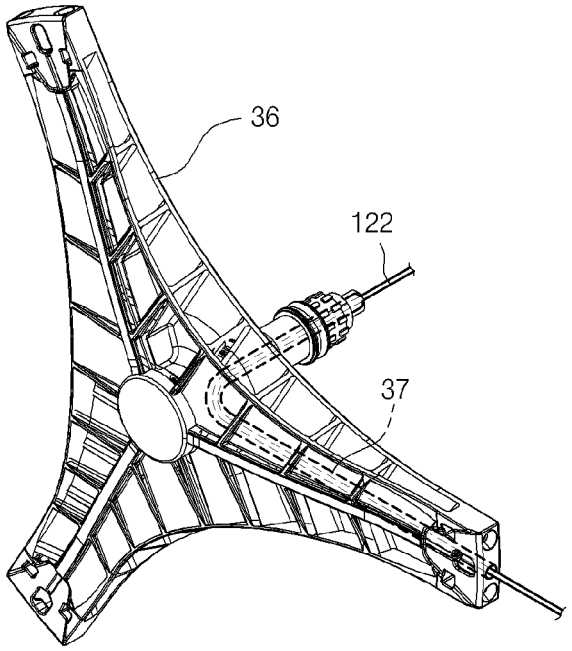
FIG. 2B is a perspective view of a flange of the washing machine depicted in FIG. 1.
Figure 2C:
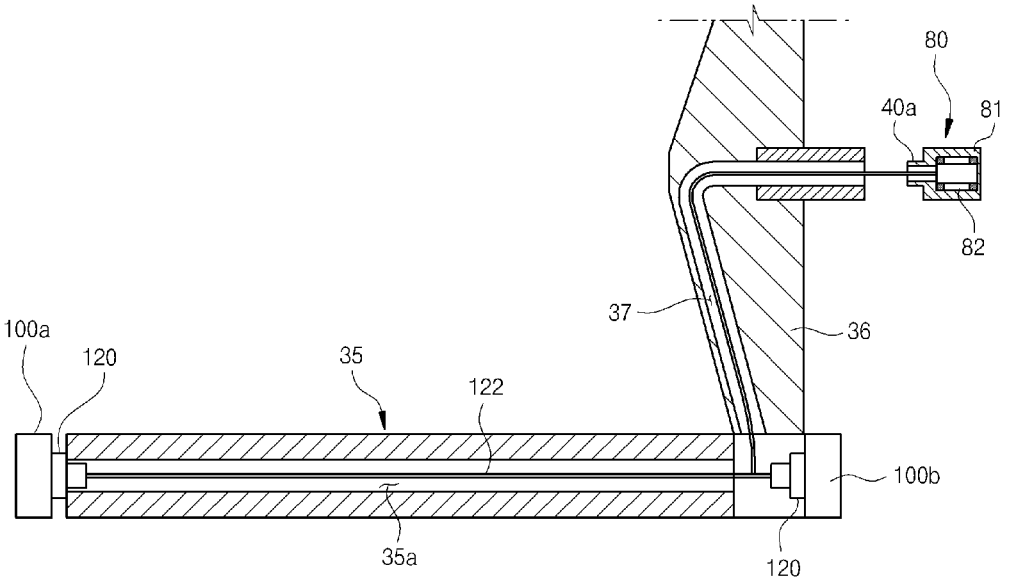
FIG. 2C is a sectional view of the rotary drum to which electric wires are mounted.

FIG. 2A is an exploded perspective view of the rotary drum of the washing machine depicted in FIG. 1, FIG. 2B is a perspective view of a flange, and FIG. 2C is a sectional view of the rotary drum.

As shown in FIG. 2A, the rotary drum 30 includes a cylindrical body 31, a front plate 32 provided at a front portion of the cylindrical body 31, and a rear plate 33 provided at a rear portion of the cylindrical body 31. The front plate 32 is formed with an opening 32*a* through which laundry is placed in or removed from the rotary drum 30.

The front plate 32 has a forwardly protruding stepped portion. A balancer is mounted to the stepped portion of the front plate 32.

The rear plate 33 is coupled to the rear portion of the cylindrical body 31 to cover the same. A flange 36 is mounted to a rear surface of the rear plate 33.

The cylindrical body 31 of the rotary drum 30 is formed with plural through-holes 34, through which the inside and the outside of the rotary drum 30 communicate with each other. A plurality of lifters 35 are mounted to an inner circumferential surface of the cylindrical body 31 of the rotary drum 30.

The driving shaft 42 is coupled to a center portion of the flange 36. A balancer is mounted to a rear surface of the flange 36.

The balancer mounted to the front plate 32 is called a front balancer 100*a*, and the balancer mounted to the rear surface of the flange 36 is called a rear balancer 100*b*. Although as a non-limiting example, two balancers are shown in FIG. 2A, the present disclosure is not limited thereto. The washing machine may include at least one balancer.

The flange 36 is provided with a guide part 37 through which the electric wire 122 passes.

As shown in FIG. 2B, the guide part 37 defines a receiving space in the flange 36, and the receiving space of the guide part 37 communicates with the hollow portion of the driving shaft 42. Accordingly, the electric wire 122 received in the hollow portion of the driving shaft 42 may pass through the receiving space of the guide part 37.

That is, the guide part 37 extends from the driving shaft 42, and guides the electric wire 122 from the outside of the tub 20 to the inside of the tub 20 through the driving shaft 42.

The guide part 37 is sealed from the outside. Alternatively, the guide part with an enclosed structure may be provided outside the flange.

The electric wire 122 passes through the hollow portion of the driving shaft 42 and the receiving space of the guide part 37 of the flange 36, and serves to transmit external electric power to the front balancer 100*a* and the rear balancer 100*b*.

In detail, as shown in FIG. 2C, a part of the electric wire 122 passing through the receiving space of the guide part 37 extends to a connector 120 of the rear balancer 100*b*, and is electrically and mechanically connected to the same. The other part of the electric wire 122 extends to a connector 120 of the front balancer 100*a* through the lifter 35, and is electrically and mechanically connected to the same.

An insertion part 35*a* is formed inside the lifter 35, into which the electric wire 122 is inserted. The electric wire 122 inserted into the insertion part 35*a* extends to the front balancer 100*a* positioned in front of the rotary drum from the rear portion of the rotary drum.

The flange, the front balancer and the rear balancer are fixed to the cylindrical body of the rotary drum. Because the cylindrical body of the rotary drum, the flange, the front balancer, the rear balancer and the electric wire rotate integrally by rotation of the wash motor 40, the electric wire is prevented from being twisted.

Figure 3A:
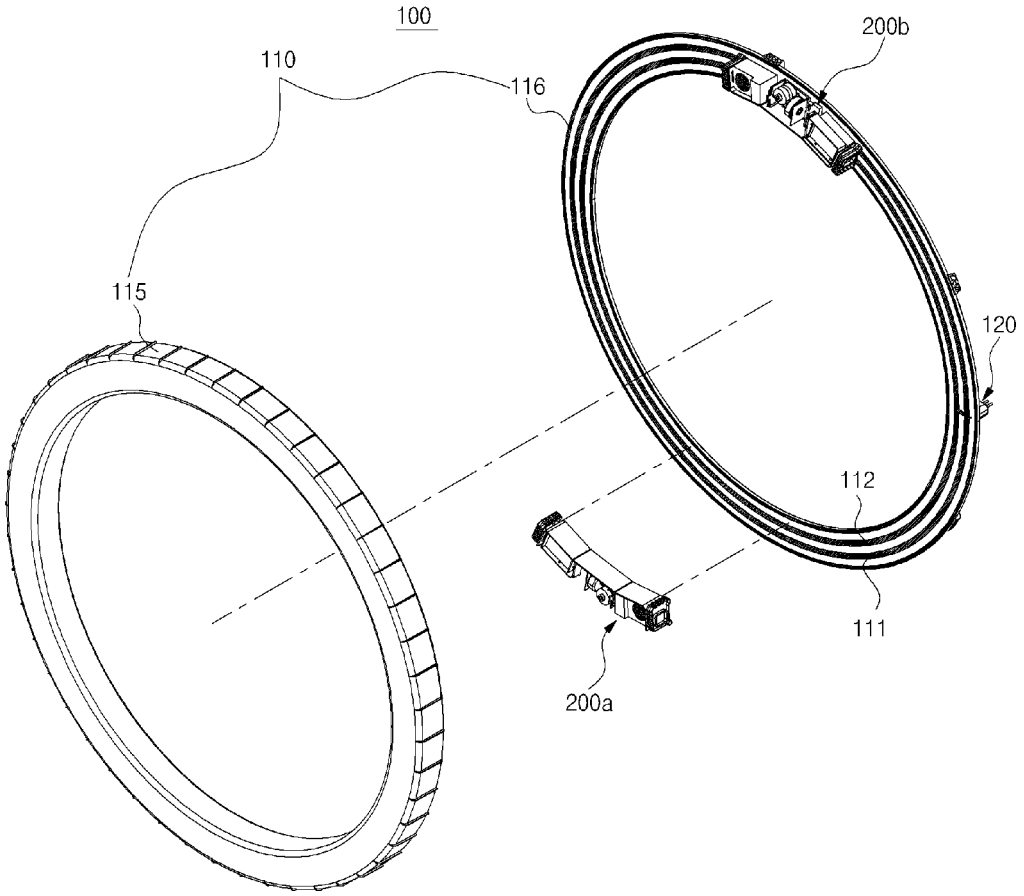
FIG. 3A is an exploded perspective view of a balancer according to an embodiment of the present disclosure.
Figure 3B:
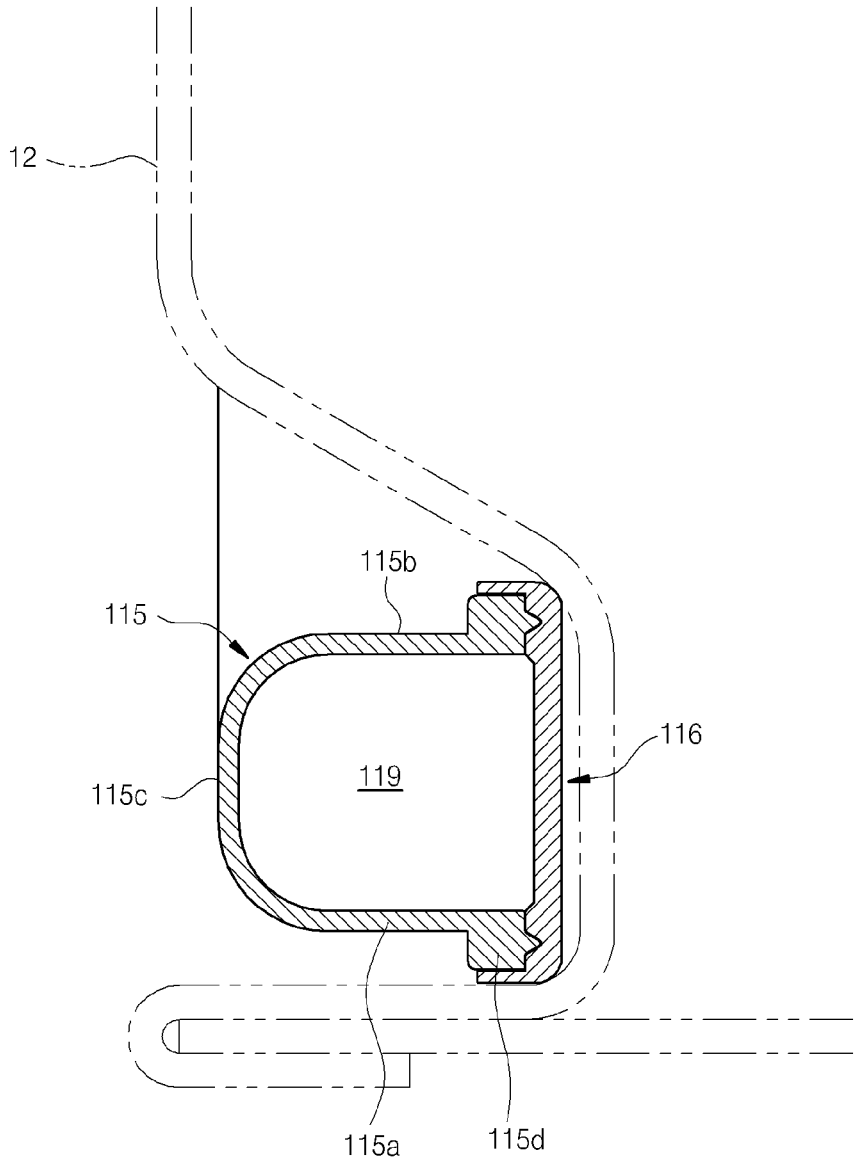
FIG. 3B is a sectional view of a balancer housing of the balancer according to an embodiment of the present disclosure.

FIG. 3A is an exploded perspective view of the balancer according to an embodiment of the present disclosure, and FIG. 3B is a sectional view of a balancer housing of the balancer according to an embodiment of the present disclosure. The front balancer 100*a* and the rear balancer 100*b* have the same structure.

As shown in FIG. 3A, the balancer 100 (100*a* and 100*b*) includes a balancer housing 110 and balancing modules 200*a* and 200*b* provided inside the balancer housing 110.

In this embodiment, as a non-limiting example, two balancing modules 200*a* and 200*b* are provided at each balancer 100. However, the number of balancing modules may be less or greater than two.

The balancer housing 110 includes a first housing 115 formed in a ring shape with an opening, and a second housing 116 covering the opening of the first housing 115. The first housing 115 and the second housing 116 may be welded to each other, and define an enclosed internal space 119 therebetween. However, the present disclosure is not limited thereto. For example, other methods of securing the first housing 115 to the second housing 116 may be used such as mounting with fastening members. The structure of the balancer housing will now be explained with reference to FIG. 3B.

The first housing 115 includes a first wall 115*a*, a second wall 115*b* opposing the first wall 115*a*, and a third wall 115*c* connecting end portions of the first and second walls 115*a* and 115*b*, thereby having a about 90° rotated U-shaped section. The second housing 116 has inner and outer rims which are bent toward the first housing 115. The inner and outer rims of the second housing 116 are thermally welded to inner and outer rims 115*d* of the first housing 115. However, the present disclosure is not limited thereto. For example, other methods of securing the inner and outer rims of the first and second housing may be used such as mounting with fastening members.

For thermal welding, the inner and outer rims 115*d* of the first housing 115 protrude outwardly from the first and second walls 115*a* and 115*b* of the first housing 115, and the second housing 116 has a size to cover the rims 115*d* of the first housing 115.

Electrodes 111 and 112 are provided at an inner surface of the second housing 116 in order to transmit electric power from an external power source to the balancing modules 200*a* and 200*b*. The electrodes 111 and 112 may be formed by coating a conductive film on the inner surface of the balancer housing. The electrodes 111 and 112 have different polarities. That is, one of the electrodes 111 and 112 is a positive electrode and the other is a negative electrode.

The electrodes 111 and 112 are provided along the circumference of the ring-shaped second housing 116. Therefore, although the balancing modules 200*a* and 200*b* move and the positions thereof are changed in the balancer housing 110, the electrodes 111 and 112 may continuously transmit electric power to the balancing modules 200*a* and 200*b*.

In an embodiment, the electrodes 111 and 112 are positioned at the second housing 116. However, the electrodes may be positioned at any other portion of the balancer housing 110.

In the case that both the front balancer 100*a* and the rear balancer 100*b* are coupled to the cylindrical body 31 interposed therebetween, the second housing of the front balancer 100*a* and the second housing of the rear balancer 100*b* oppose each other while interposing the cylindrical body 31 therebetween, and the first housing of the front balancer 100*a* and the first housing of the rear balancer 100*b* are directed outward.

A connector 120 is provided at an outer surface of the second housing 116 of the balancer housing 110, in order to electrically connect the electrodes 111 and 112 to an external power source (not shown).

The connector 120 of the front balancer 100*a* is directed toward the lifter 35 of the cylindrical body 31 and the flange 36, and the connector 120 of the rear balancer 100*b* is directed toward the flange 36.

That is, the connector of the front balancer 100*a* is disposed adjacent to the lifter 35 accommodating the electric wire 122 therein, and the connector of the rear balancer 100*b* is disposed adjacent to the guide part 37 of the flange 36.

Because the connectors of the front and rear balancers 100*a* and 100*b* are directed toward the flange 36, connection with the electric wire 122 passing through the guide part 37 of the flange 36 may be facilitated.

Figure 4:
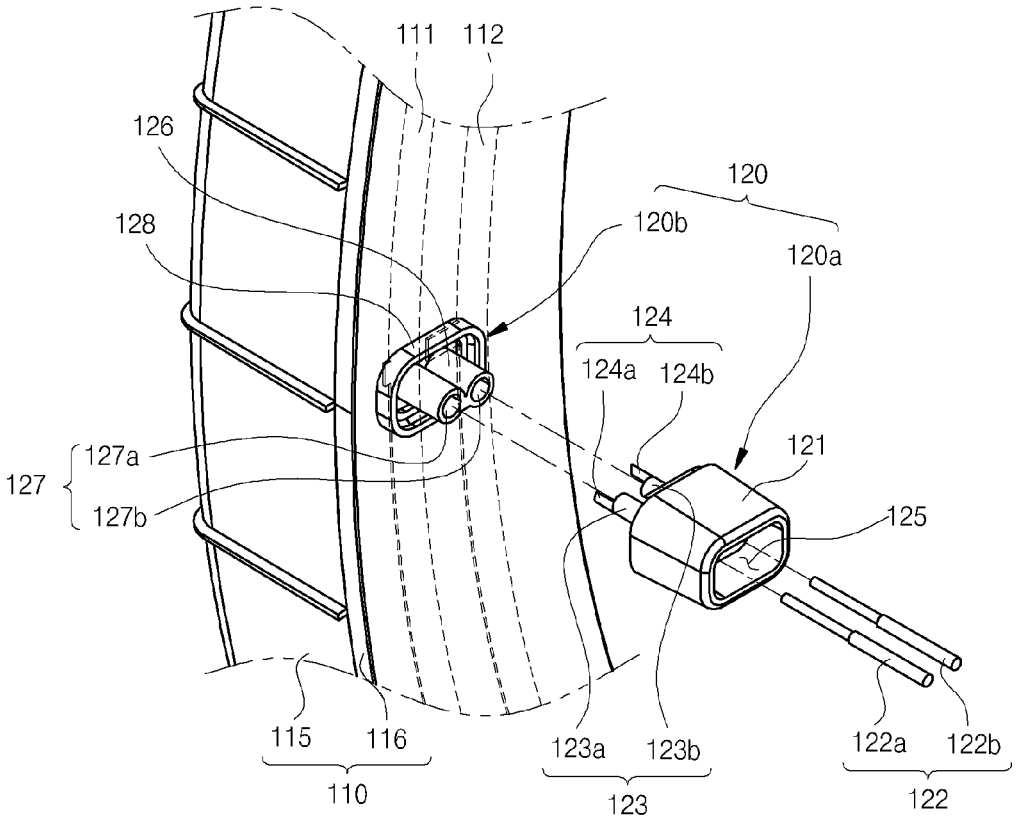
FIGS. 4 and 5 are views illustrating the balancer housing and a connector.
Figure 5:
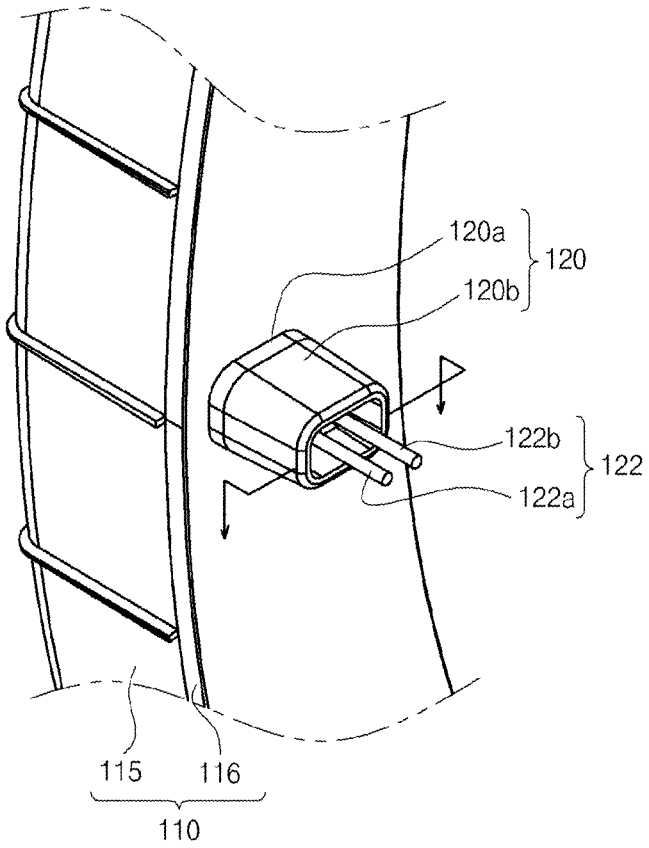
Figure 6:
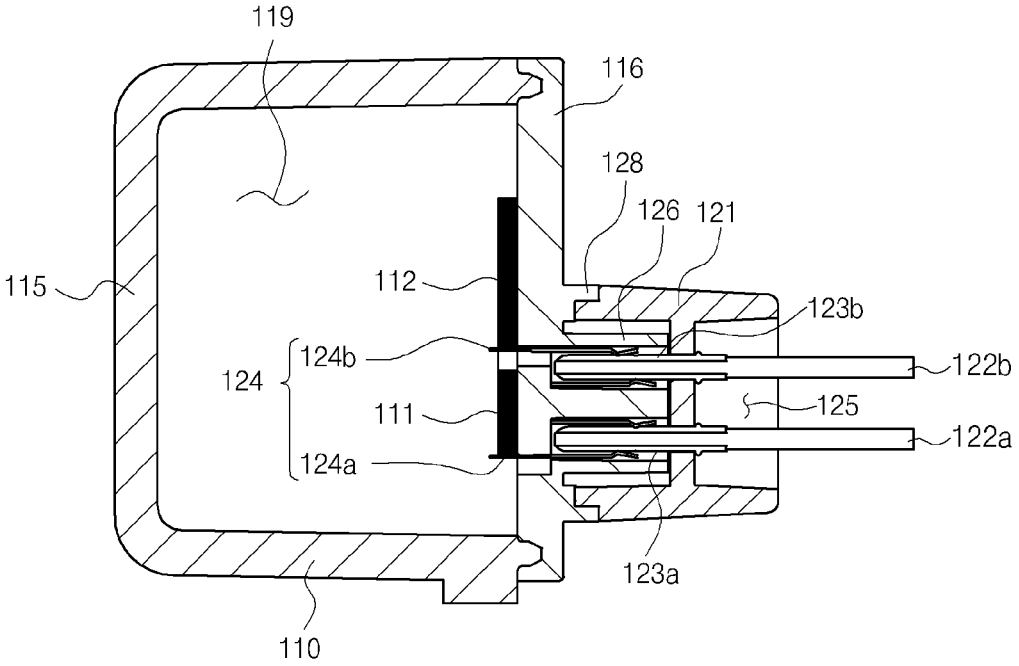
FIG. 6 is a sectional view taken along line I-I in FIG. 5.

FIGS. 4 and 5 are views illustrating the balancer housing and the connector, and FIG. 6 is a sectional view taken along line I-I in FIG. 5.

As shown in FIGS. 4 through 6, the connector 120 is disposed at the outer surface of the second housing 116 of the balancer housing 110. The connector 120 includes a plug unit 120*a* and a socket unit 120*b*.

The plug unit 120*a* includes a plug body 121 and electric wires 122 (122*a* and 122*b*) provided in the plug body 121.

The plug unit 120*a* serves to support the electric wires 122*a* and 122*b* electrically connecting an external power source (not shown) and the balancer housing 110, so as to easily connect the electric wires 122*a* and 122*b* to the balancer housing 110.

The socket unit 120*b* is coupled to the balancer housing 110 and engaged with the plug unit 120*a*, thereby connecting the balancer housing 110 and the plug unit 120*a*.

The plug unit 120*a* is provided with wire terminals 123 (123*a* and 123*b*) inserted therein, to which the electric wires 122*a* and 122*b* are connected. The wire terminals 123*a* and 123*b* serve to support the flexible electric wires 122*a* and 122*b* to be easily inserted into the socket unit 120*b*.

The wire terminals 123*a* and 123*b* may protrude from the plug unit 120*a*. As described above, because the electrodes 111 and 112 have two different polarities, i.e., positive polarity and negative polarity, and the number of electric wires 122*a* and 122*b* connected to the electrodes 111 and 112 is two, the number of wire terminals 123*a* and 123*b* is also two.

The socket unit 120*b* may protrude from the outer surface of the second housing 116 of the balancer housing 110. The socket unit 120*b* may be positioned at any other portion of the balancer housing 110.

The socket unit 120*b* includes a socket body 126. Socket holes 127 (127*a* and 127*b*) are formed in the socket body 126, into which the wire terminals 123*a* and 123*b* are inserted. That is, the socket unit 120*b* may have a hollow shape as a whole. The number of socket holes 127*a* and 127*b* is also two. One of the socket holes 127*a* and 127*b* has positive polarity and the other has negative polarity.

Electrode terminals 124 (124*a* and 124*b*) are provided in the socket holes 127*a* and 127*b*. The electrode terminals 124*a* and 124*b* electrically connect the electrodes 111 and 112 and the wire terminals 123*a* and 123*b*. The electric wires 122*a* and 122*b* may be connected to the electrodes 111 and 112 corresponding to the respective polarities by the electrode terminals 124*a* and 124*b*.

The socket unit 120*b* further includes a protruding part 128 surrounding the socket body 126. The protruding part 128 protrudes from the outer surface of the second housing 116 of the balancer housing 110. The protruding part 128 may have the same size as the peripheral surface of the plug unit 120*a*. Accordingly, when the plug unit 120*a* is engaged with the socket unit 120*b*, the peripheral surface of the protruding part 128 and the peripheral surface of the plug unit 120*a* may be smoothly connected.

An assembly method of the connector 120 includes the processes of connecting the wire terminals 123*a* and 123*b* to end portions of the electric wires 122*a* and 122*b*, mounting the electric wires 122*a* and 122*b* with the wire terminals 123*a* and 123*b* to the plug unit 120*a*, and engaging the plug unit 120*a* with the socket unit 120*b*. As a result, the electric wires 122*a* and 122*b* and the electrodes 111 and 112 may be electrically connected.

Because the balancer housing 110 is accommodated in the tub 20, the outer surface of the balancer housing 110 may constantly contact wash water. Therefore, the connector 120 with the electrical structure is required to have a waterproof structure.

The plug unit 120*a* is formed with a waterproof recess 125 which is depressed inwardly at a portion thereof. The waterproof recess 125 is positioned at a portion of the plug unit 120*a* opposite to the portion engaged with the socket unit 120*b*.

The electric wires 122*a* and 122*b* with the wire terminals 123*a* and 123*b* are inserted and fixed into the waterproof recess 125. The waterproof recess 125 is filled with an epoxy resin so as to achieve waterproof effects of the plug unit 120*a*.

The engaged portion between the protruding part 128 of the socket unit 120*b* and the plug unit 120*a* is also required to have a waterproof structure. Any suitable engagement method achieving waterproof effects may be adopted to engage the protruding part 128 of the socket unit 120*b* and the plug unit 120*a*. In an embodiment, as a non-limiting example, the protruding part 128 of the socket unit 120*b* and the plug unit 120*a* are not only engaged but also achieve waterproof effects through ultrasonic welding.

Any suitable waterproof structure and method other than the epoxy resin-filling method and the ultrasonic welding method may be included in the principles and spirit of the present disclosure.

Figure 7:
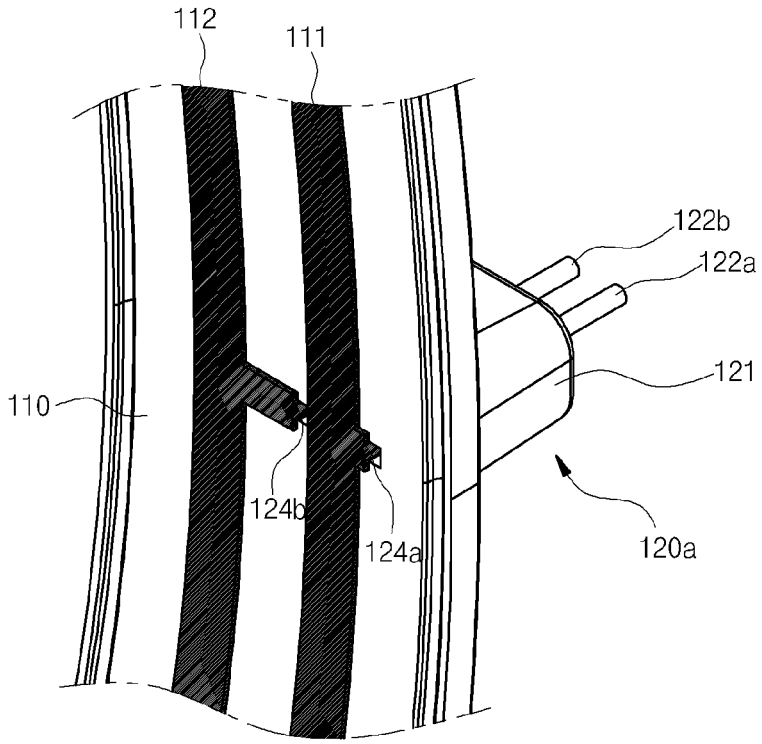
FIG. 7 is a view illustrating the balancer housing and electrodes.

FIG. 7 is a view illustrating the balancer housing and the electrodes.

As shown in FIG. 7, when a width of the electrodes 111 and 112 may be different from a width of the connector, a portion of the electrodes 111 and 112 may protrude so as to contact the electrode terminals 124*a* and 124*b*.

Figure 8:
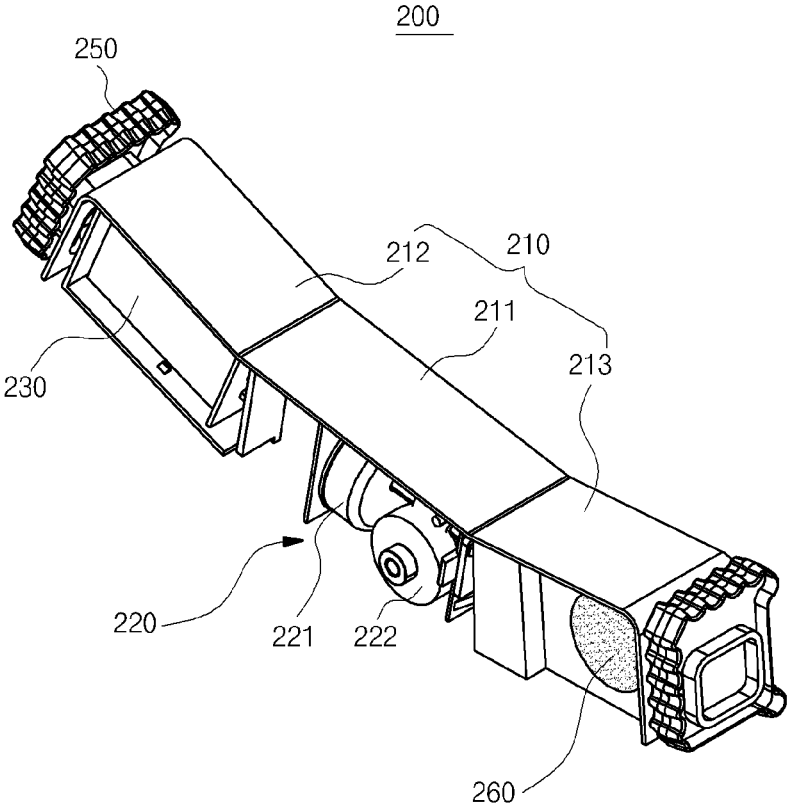
FIG. 8 is a view illustrating a balancing module according to an embodiment of the present disclosure.
Figure 9:
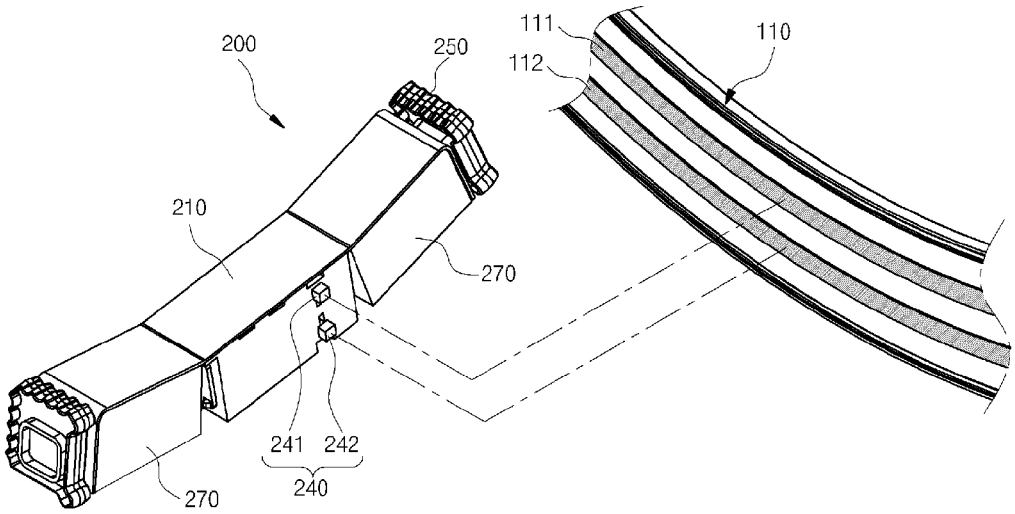
FIG. 9 is a view illustrating the balancer housing and the balancing module according to an embodiment of the present disclosure.

FIG. 8 is a view illustrating the balancing module according to an embodiment of the present disclosure, and FIG. 9 is a view illustrating the balancer housing and the balancing module according to an embodiment of the present disclosure.

Hereinafter, the balancing module disposed in a ring-shaped channel 119 (refer to FIG. 6) formed in the balancer housing 110 (refer to FIG. 3) will be explained.

As shown in FIGS. 8 and 9, the balancing module 200 includes a main plate 210 defining a basic shape of the balancing module 200.

The main plate 210 includes a middle plate 211 and side plates 212 and 213 disposed at both sides of the middle plate 211. The side plates 212 and 213 incline with respect to the middle plate 211 at a certain angle. Accordingly, the balancing module 200 may easily move along the ring-shaped channel 119.

The side plates 212 and 213 are respectively provided with counterweights 270. The counterweights 270 serve to counterbalance the unbalanced load occurring when laundry accumulates at one side of the rotary drum 30, thereby balancing rotation of the rotary drum 30.

One of the counterweights 270 is mounted with a control module 230 at a front surface thereof. The control module 230 includes components to enable a moving unit 220 to operate.

The other of the counterweights 270 is mounted with a position detecting part 260. The position detecting part 260 may be configured as a magnetic body including a permanent magnet, a light emitting element or a reflective plate to reflect light radiated thereto.

A position sensor 23 may be mounted to the tub 20 at a position corresponding to the balancer housing 110. The position sensor 23 detects the position of the balancing module 200. The position sensor 23 may be configured as a hall sensor, an infrared sensor or an optical fiber sensor, for example.

When the position sensor is a hall sensor, the position detecting part may be a magnetic body. When the position sensor is an infrared sensor, the position detecting part may be a light emitting element. When the position sensor is an optical fiber sensor, the position detecting part may be a reflective plate.

Bearings 250 are respectively coupled to end portions of the side plates 212 and 213. The Bearings 250 serve to prevent the balancing module 200 from colliding with the inner surface of the balancer housing 110. In addition, the bearings 250 serve to restrict free movement of the balancing module 200 to a certain extent, so that the balancing module 200 may be fixed at the accurate position capable of counterbalancing the unbalanced load. This will be explained later with reference to FIG. 11.

A moving unit 220 is mounted to the middle plate 211. The moving unit 220 includes at least one wheel 222 which enables the balancing module 200 to move, and a movement motor 221 to rotate the wheel 222. This will be explained later with reference to FIG. 10.

Brushes 240 (241 and 242) may be provided at the rear portion of the moving unit 220. The brushes 241 and 242 are in contact with the electrodes 111 and 112 of the balancer housing 110 and are electrically connected to the electrodes 111 and 112. Even when the balancing module 200 moves, the brushes 241 and 242 keep contact with the electrodes 111 and 112, thereby constantly supplying electric power to the balancing module 200, especially, to the moving unit 220.

Corresponding to two positive and negative electrodes 111 and 112, the number of brushes 241 and 242 may also be two. Two brushes 241 and 242 may be arranged so as to respectively contact the electrodes 111 and 112.

Because the brushes 241 and 242 are in contact with the electrodes 111 and 112 in the rotary drum 30 which vibrates while rotating, the brushes 241 and 242 may be damaged. In order to prevent such damage, internal end portions of the brushes 241 and 242 may be supported by elastic members.

Figure 10:
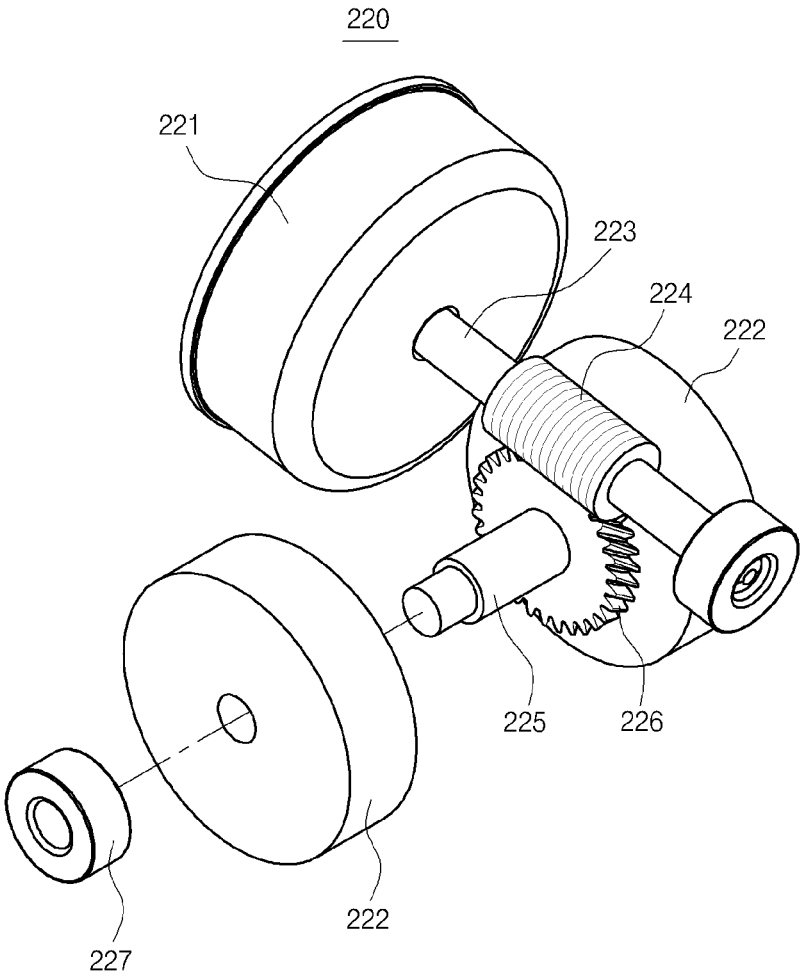
FIG. 10 is a view illustrating a moving unit depicted in FIG. 8.

FIG. 10 is a view illustrating the moving unit depicted in FIG. 8.

As shown in FIG. 10, the moving unit 220 includes at least one wheel 222 which enables the balancing module 200 to move, and a movement motor 221 to rotate the wheel 222.

Gears 224 and 226 are provided between the movement motor 221 and the wheel 222, in order to transmit driving force from the movement motor 221 to the wheel 222.

In this embodiment, because a driving shaft 223 of the movement motor 221 and a rotation shaft 225 of the wheel 222 are perpendicular to each other, the gears include a first gear 224 and a second gear 226 which are configured as a worm gear.

The first gear 224 is formed at the driving shaft 223 of the movement motor 221, and the second gear 226 is engaged with the first gear 224 to rotate with the same. The rotation shaft 225 is coupled through a center portion of the second gear 226, and a plurality of wheels 222 are mounted to both end portions of the rotation shaft 225. A wheel cap 227 secures each wheel 222 to the rotation shaft 225.

The first and second gears 224 and 226 may be configured as a helical gear which is a cylindrical shaped gear with helicoid teeth.

The first and second gears 224 and 226, which are configured as a worm gear or a helical gear, may restrict rotation of the wheels 222 when the movement motor 221 is inactivated. Accordingly, when electric power is not supplied from an external power source (not shown), the balancing module 200 may not move, but may be fixed at a final position.

Figure 11:
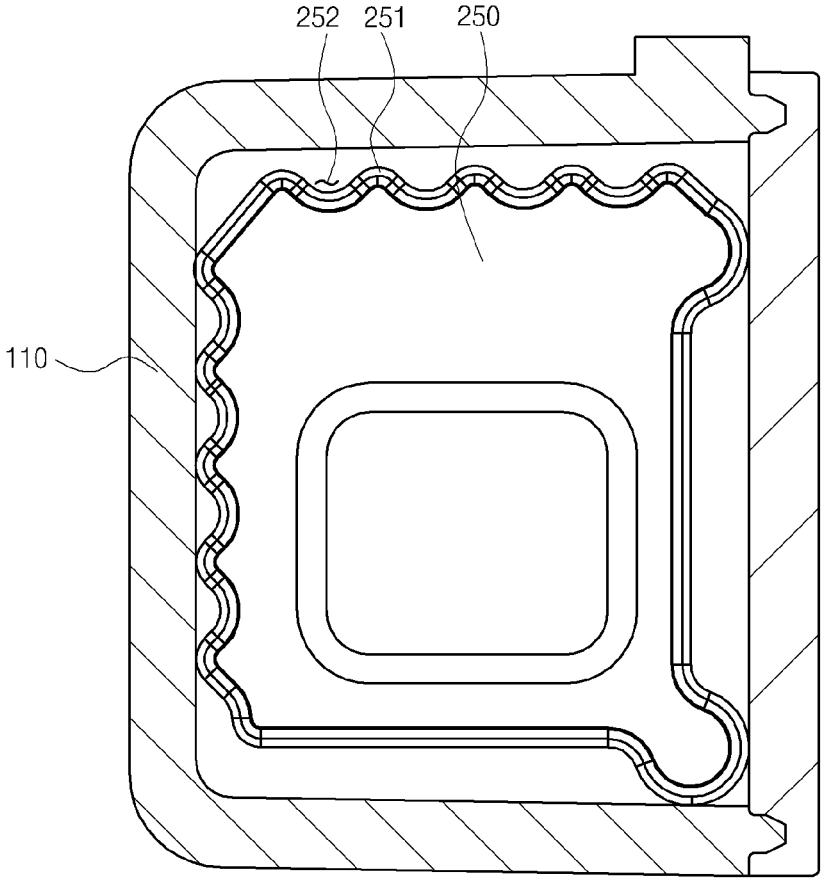
FIG. 11 is a view illustrating a bearing and the balancer housing according to an embodiment of the present disclosure.

FIG. 11 is a view illustrating the bearing and the balancer housing according to an embodiment of the present disclosure.

As shown in FIG. 11, the bearing 250 is formed to contact the inner surface of the balancer housing 110. The bearing 250 in an embodiment is configured as a friction bearing. While contacting the inner surface of the balancer housing 110, the bearing 250 serves to restrict movement of the balancing module 200 to a certain extent and also prevent the balancing module 200 from colliding with the inner surface of the balancer housing 110.

The bearing 250 includes convex portions 251 which come into contact with the inner surface of the balancer housing 110, and concave portions 252 which are depressed from the convex portions 251. That is, the bearing 250 has a wavy surface.

Foreign materials present in the balancer housing 110 may pass through the concave portions 252, thereby preventing the foreign materials from gathering at the concave portions 252 and blocking movement of the balancing module 200.

In addition, by adjusting a size of the convex portions 251, the balancing module 200 may be prevented from colliding with the inner surface of the balancer housing 110, and the brushes 241 and 242 may contact the electrodes 111 and 112 while an adequate distance is maintained between the balancing module 200 and the inner surface of the balancer housing 110.

Figure 12:
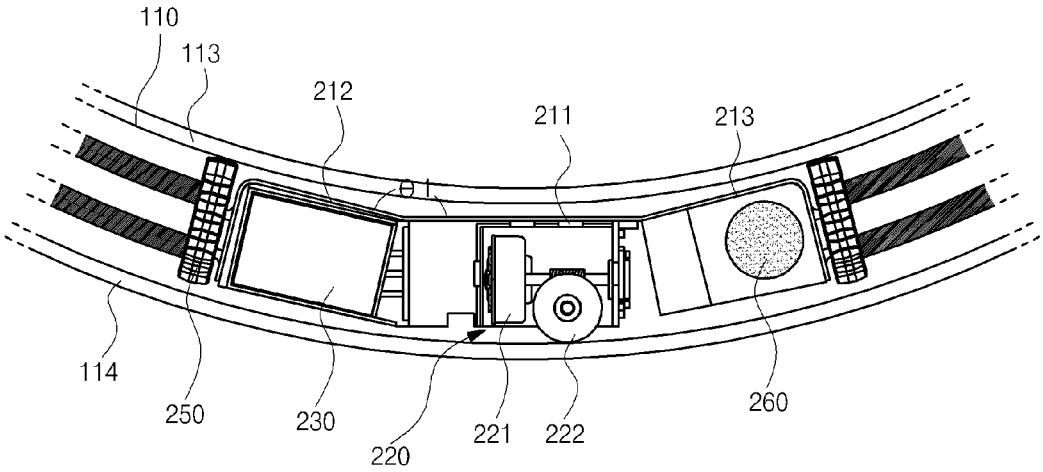
FIGS. 12 and 13 are views illustrating operation of the balancing module in the balancer housing.
Figure 13:
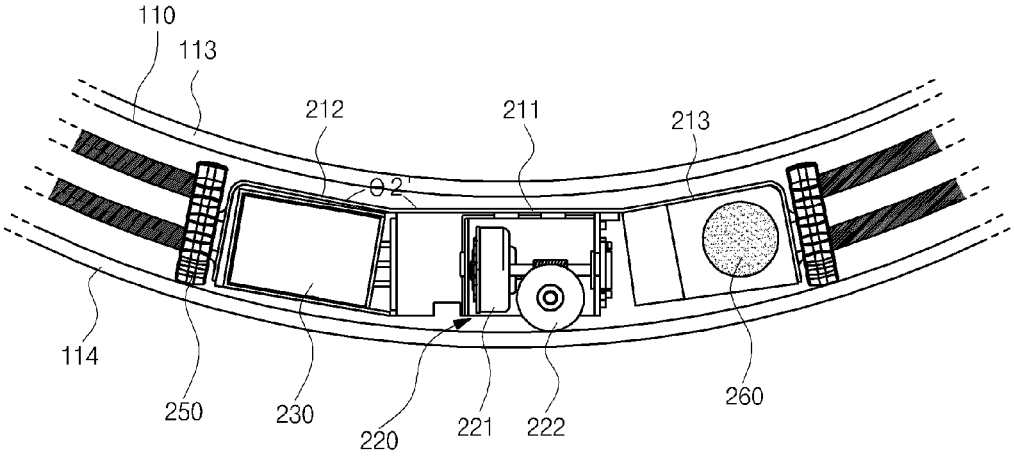

FIGS. 12 and 13 are views illustrating operation of the balancing module in the balancer housing.

FIG. 12 illustrates an operational state of the balancing module 200 when the rotary drum 30 rotates at a relatively low speed or is in a stationary state.

As shown in FIG. 12, the main plate 210 of the balancing module 200 maintains an initial state thereof. Therefore, the middle plate 211 and the side plates 212 and 213 maintain a certain intial angle θ1 therebetween.

The bearings 250 mounted to the end portions of the side plates 212 and 213 contact a first inner surface 113 of the balancer housing 110, which is positioned inwardly in a radial direction of the balancer housing 110. The wheels 222 contact a second inner surface 114 of the balancer housing 110, which is positioned outwardly in the radial direction of the balancer housing 110. That is, the contact regions between the balancing module 200 and the balancer housing 110 include the contact regions between the bearings 250 and the first inner surface 113 and the contact regions between the wheels 222 and the second inner surface 114. The wheels 222 are pressurized toward the second inner surface 114 of the balancer housing 110.

FIG. 13 illustrates an operational state of the balancing module 200 when the rotary drum 30 rotates at a relatively high speed.

As shown in FIG. 13, by centrifugal force, an angle θ2 between the middle plate 211 and the side plates 212 and 213 becomes larger than the angle θ1 in the stationary state of the rotary drum 30. That is, the side plates 212 and 213 further spread outwardly in the radial direction of the balancer housing 110.

As the side plates 212 and 213 spread out, both the bearings 250 and the wheels 222 come into contact with the second inner surface 114 of the balancer housing 110.

Accordingly, the pressure applied to the wheels 222 decreases, and the wheels 222 may rotate more freely, which enables the balancing module 200 to easily move to a desired position. That is, because the balancing module 200 moves more freely in the high speed rotating state of the rotary drum 30, the balancing module 200 may move to a position capable of more rapidly counterbalancing the unbalanced load of the rotary drum 30.

Figure 14:
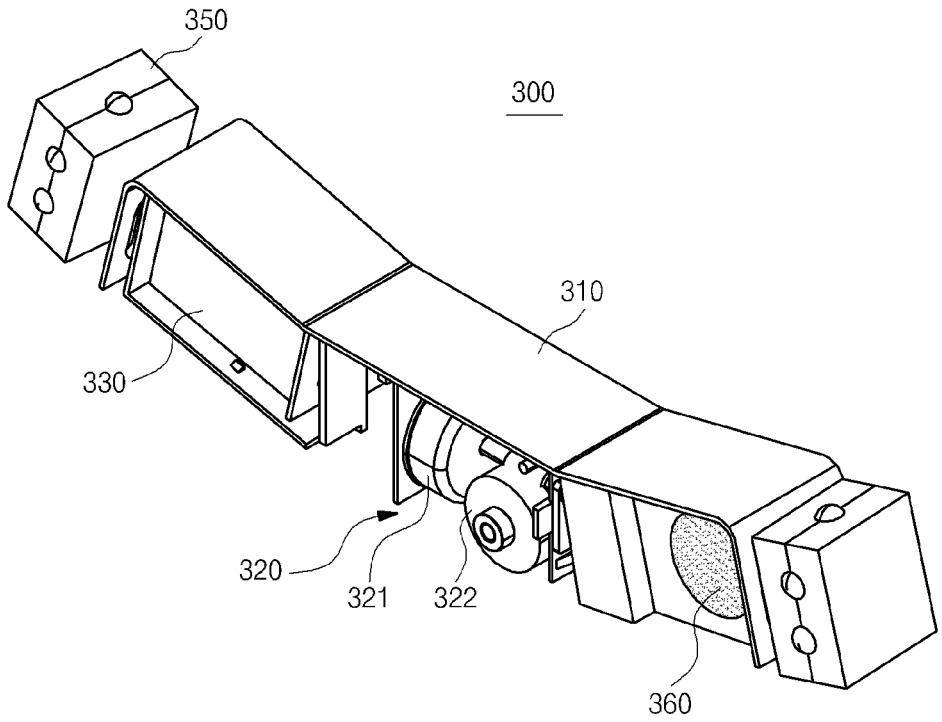
FIG. 14 is a view illustrating a balancing module according to another embodiment of the present disclosure.

FIG. 14 is a view illustrating a balancing module according to another embodiment of the present disclosure.

As shown in FIG. 14, a balancing module 300 according to another embodiment of the present disclosure includes a main plate 310 defining a basic shape of the balancing module 300.

The main plate 310 is provided with counterweights (not shown) and a moving unit 320.

The moving unit 320 includes at least one wheel 322 which enables the balancing module 300 to move, and a movement motor 321 to rotate the wheel 322.

Bearings 350 are mounted to both end portions of the main plate 310. In an embodiment, the bearings 350 are configured as a ball bearing. Accordingly, the balancing module 300 may easily move inside the balancer housing 110 by the bearings 350.

Figure 15:
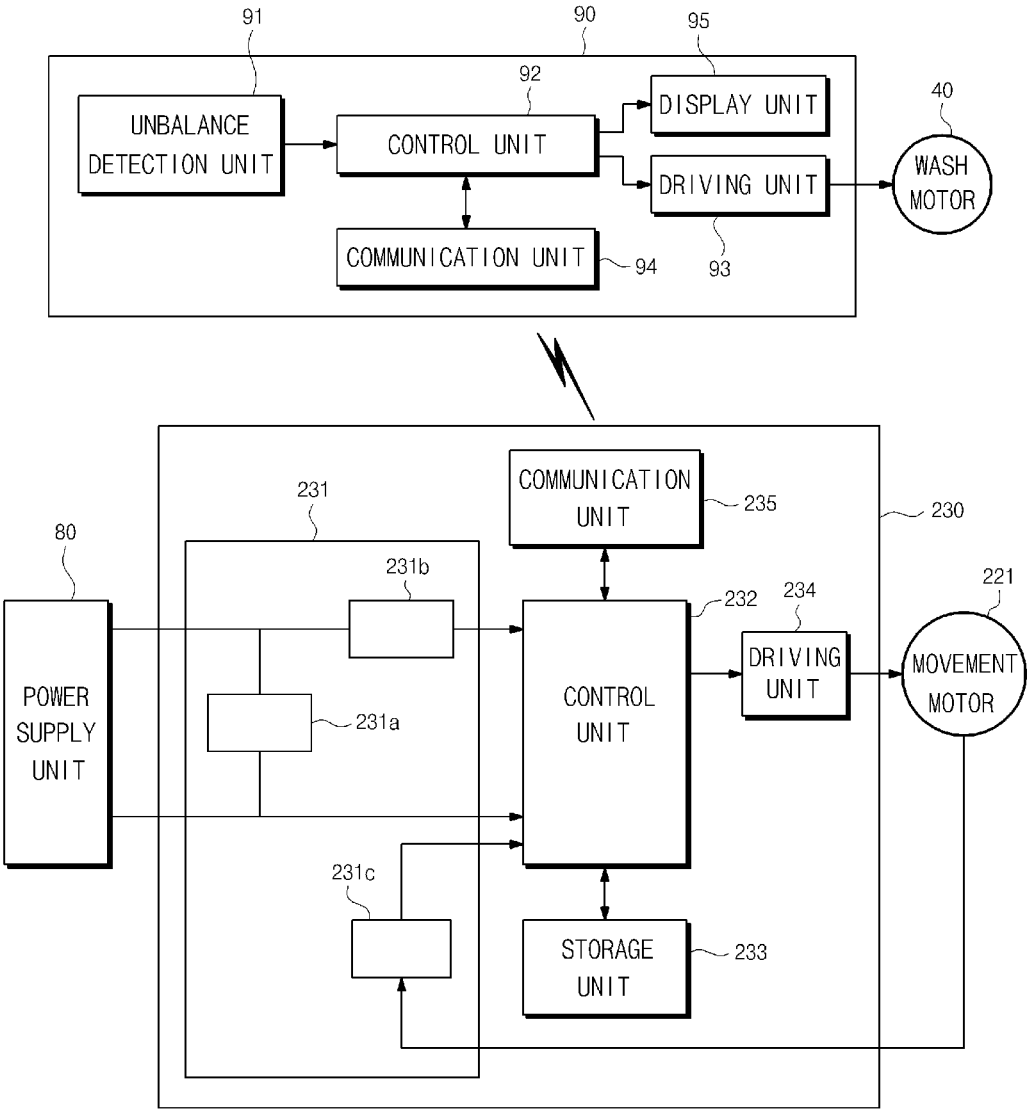
FIG. 15 is a control block diagram of the washing machine according to an embodiment of the present disclosure.

FIG. 15 is a control block diagram of the washing machine having the balancer. The washing machine includes a control module 230 to diagnose a malfunction of the balancer 100.

A main control module 90 controls the processes of supplying water, draining, washing, rinsing, dehydrating and the like, based on an operation command input by a user.

In the dehydration process, the main control module 90 controls rotation of the wash motor 40 and simultaneously checks the amount of unbalance. The main control module 90 controls rotation of the wash motor 40 based on the checked amount of unbalance, or transmits the checked amount of unbalance to the control module 230 of the balancer.

The main control module 90 includes an unbalance detection unit 91, a control unit 92, a driving unit 93, a communication unit 94 and a display unit 95.

The unbalance detection unit 91 detects the amount of unbalance occurring by laundry unevenly distributed in the rotary drum. Here, the amount of unbalance includes unbalanced force exerted on the rotary drum.

The control unit 92 compares the amount of unbalance detected by the unbalance detection unit 91 with the reference amount of unbalance. If the detected amount of unbalance is less than or equal to the reference amount of unbalance, the control unit 92 controls the wash motor 40 to accelerate. If the detected amount of unbalance exceeds the reference amount of unbalance, the control unit 92 transmits the checked amount of unbalance to the control module 230 of the balancer in order to control the balance of the rotary drum.

If a balancer malfunction signal from the control module 230 of the balancer is transmitted to the control unit 92, the control unit 92 controls the display unit 95 to display the malfunction signal.

The driving unit 93 rotates the wash motor 40 in forward and reverse directions based on the command of the control unit 92.

The communication unit 94 transmits the detected amount of unbalance to the control module 230 of the balancer based on the command of the control unit 92. In addition, if a balancer malfunction signal from the control module 230 of the balancer is transmitted, the communication unit 94 transmits the balancer malfunction signal to the control unit 92.

The display unit 95 displays a malfunction of the balancer 100 using error codes corresponding to the balancer malfunction signals. The error codes respectively representing the balancer malfunction signals are previously set and stored.

The control module 230 of the balancer receives the detected amount of unbalance from the main control module 90 for operation control of the washing machine, and controls rotation of the movement motor 221 based on the detected amount of unbalance.

The control module 230 diagnoses a malfunction of the balancer 100 based on an electric signal of electric power supplied from a power supply unit 80. If it is determined that the balancer malfunctions based on diagnosis results, the control module 230 transmits the balancer malfunction signal to the main control module 90.

The power supply unit 80 may be configured as a slip ring, an electric generator, a wireless power transfer device, a battery or a switched mode power supply (SMPS), for example.

The control module 230 includes a detection unit 231, a control unit 232, a storage unit 233, a driving unit 234 and a communication unit 235.

The detection unit 231 detects an electric signal of power supplied from the power supply unit 80, and transmits the detected electric signal to the control unit 232. The detection unit 231 includes at least one of a voltage detection unit 231*a*, which detects voltage between the electric wires 122*a* and 122*b* used as power supply lines, and an electric current detection unit 231*b*, which detects electric current flowing through the electric wires 122*a* and 122*b* used as the power supply lines.

The voltage detection unit 231*a* and the electric current detection unit 231*b* are electrically connected to the power supply unit 80 through the wires 122*a* and 122*b*, and accordingly receive electric power from the power supply unit 80.

The detection unit 231 further includes a speed detection unit 231*c* to detect a rotational speed of the movement motor 221.

The control unit 232 controls the position of the balancing module based on the detected amount of unbalance.

In detail, the control unit 232 determines a target position of the balancing module, at which force capable of compensating for unbalanced force corresponding to the detected amount of unbalance is generated, and controls rotation of the movement motor 221 so that the balancing module may move to the determined target position.

In the case that two balancing modules are provided, the control unit 232 calculates resultant force of two balancing modules capable of compensating for the unbalanced force, determines target positions of two balancing modules, at which the calculated resultant force is generated, and respectively controls rotation of two movement motors 221 of two balancing modules so that two balancing modules may respectively move to the determined target positions.

That is, the control unit 232 controls the respective positions of two balancing modules so that the resultant force generated by two balancing modules may compensate for the unbalanced force generated by laundry.

The rotational speed of the movement motor 221 detected by the speed detection unit 231*c* is fed back to the control unit 232, and the control unit 232 performs speed adjustment of the movement motor 221 so that the balancing module may move to the target position.

As described above, when unbalance of the rotary drum occurs, the unbalanced load generated in the rotary drum may be counterbalanced by moving the balancing module along the internal space of the balancer housing. As a result, vibration and noise may be reduced.

The control unit 232 diagnoses a malfunction of the balancer 100 based on an electric signal transmitted through the electric wires. If it is determined that the balancer malfunctions based on diagnosis results, the control unit 232 controls to stop movement of the balancer, and transmits the balancer malfunction signal to the main control module 90 through the communication unit 235.

The control unit 232 compares the voltage detected by the detection unit 231 with reference voltage within a normal range, and diagnoses poor contact in the power supply lines.

The control unit 232 compares electric current detected by the detection unit 231 with first reference electric current within a normal range, and diagnoses poor contact in the power supply lines. The control unit 232 compares the electric current detected by the detection unit 231 with second reference electric current, and diagnoses an electric short between the brushes. The control unit 232 compares the electric current detected by the detection unit 231 with third reference electric current, and diagnoses a malfunction of the movement motor 221.

The storage unit 233 stores the reference voltage within a normal range to diagnose a malfunction of the balancer.

In addition, the storage unit 233 stores the first reference electric current, the second reference electric current and the third reference electric current to diagnose a malfunction of the balancer.

Here, the first reference electric current is electric current within a normal range to determine poor contact in the power supply lines, the second reference electric current is electric current to determine an electric short between the brushes, and the third reference electric current is electric current to determine a malfunction of the movement motor 221. The intensity of the first reference electric current is the lowest, and the intensity of the third reference electric current is the highest.

The storage unit 233 also stores the error codes respectively representing the balancer malfunction signals.

The driving unit 234 rotates the movement motor 221 in forward and reverse directions or stops rotation of the movement motor 221 based on the command of the control unit 232.

The communication unit 235 transmits the balancer malfunction signal to the main control module 90 or transmits the detected amount of unbalance from the main control module 90 to the control unit 232 based on the command of the control unit 232.

Figure 16:
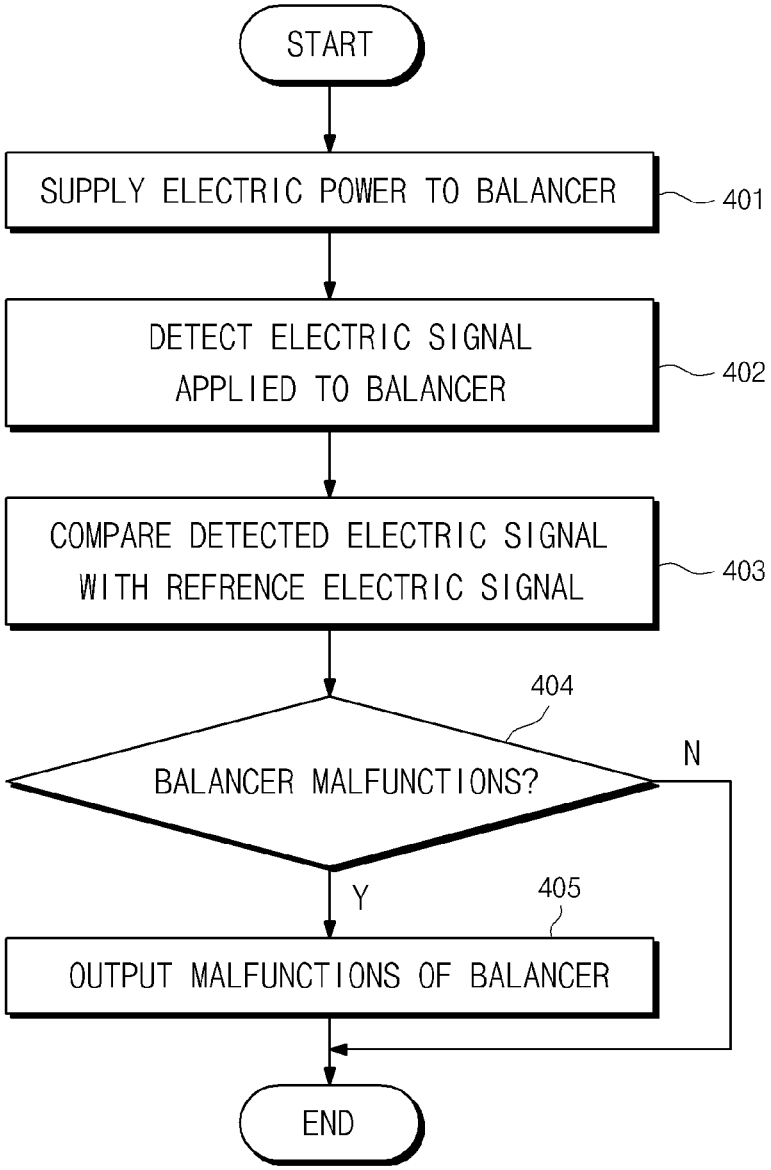
FIGS. 16 through 18 are control flowcharts of the washing machine according to an embodiment of the present disclosure.
Figure 17:
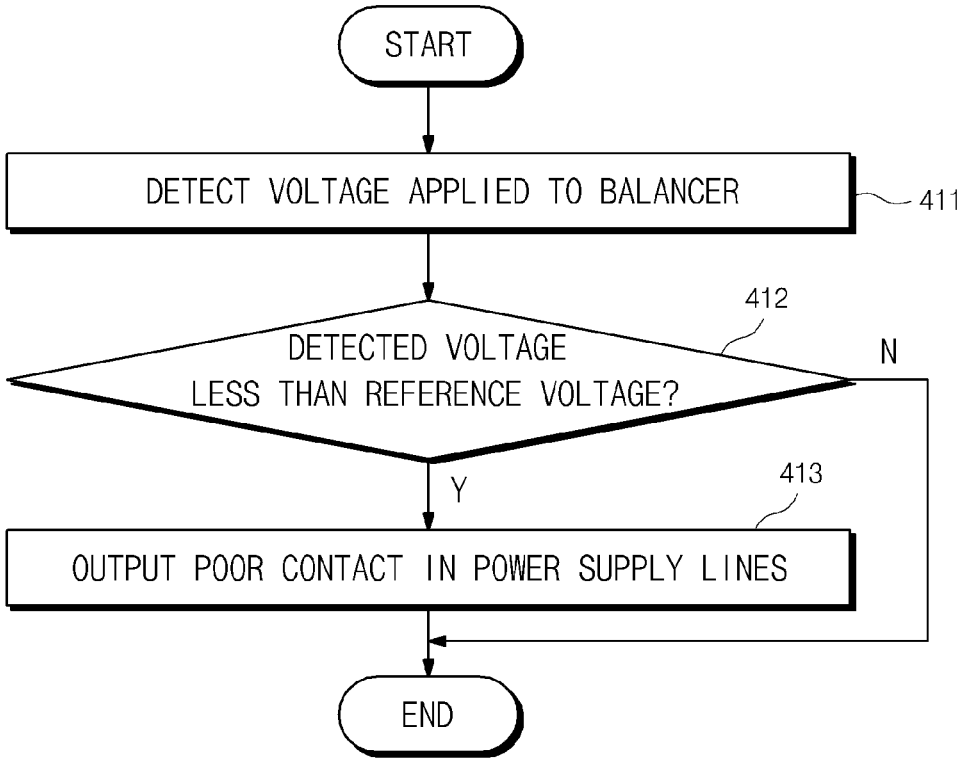
Figure 18:
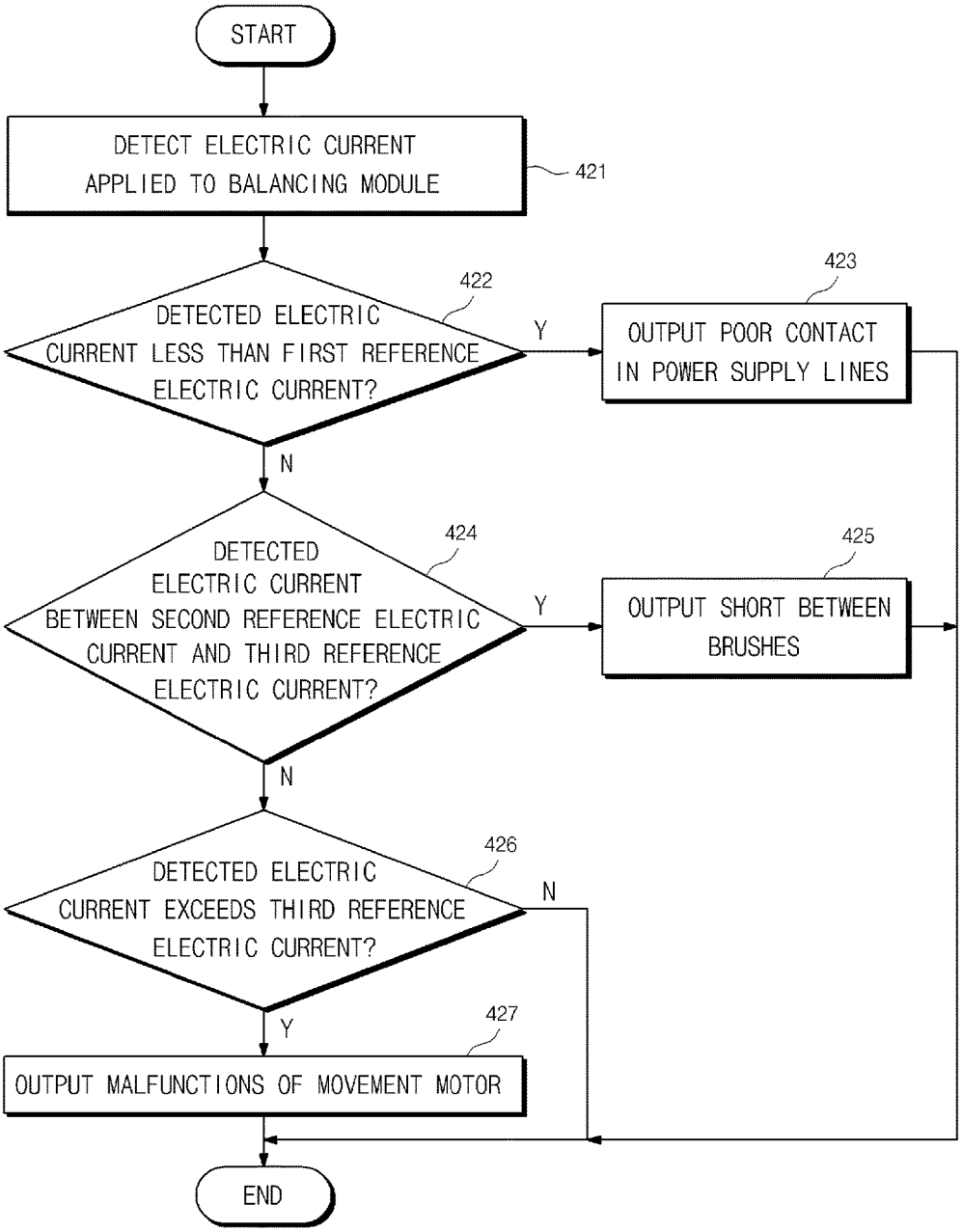

FIGS. 16 through 18 are control flowcharts of the washing machine having the balancer.

Based on an operation command input by a user through an input unit (not shown), the washing machine performs the processes of supplying water, detecting laundry, soaking laundry, draining, washing, rinsing, dehydrating and the like, and simultaneously enables the display unit 95 to display the current operation state and the following operation state.

While performing the processes of detecting laundry, soaking laundry, washing, rinsing, dehydrating and the like, the washing machine rotates the wash motor 40 in forward and reverse directions at a certain speed preset in accordance with each operation algorithm.

Through rotation of the wash motor 40, electric power is generated inside the washing machine, which is different from the commercial power. The generated electric power is supplied to at least one balancer 100 (100*a* and 100*b*) through electric wires 122 (122*a* and 122*b*).

The washing machine includes a slip ring 80 as the power supply unit, which induces electric power according to rotor rotation of the wash motor 40.

That is, when the wash motor 40 rotates, electric power is induced in the slip ring 80. The electric power induced in the slip ring 80 is transmitted to the rear balancer 100*b* through the electric wires 122 inserted into the hollow portion of the driving shaft 42 and the guide part 37 of the flange. The electric power induced in the slip ring 80 is also transmitted to the front balancer 100*a* through the electric wires 122 inserted into the hollow portion of the driving shaft 42, the guide part 37 of the flange and the insertion part 35*a* of the lifter. The electric wires 122 are connected to the connector 120 mounted to the balancer housing 110, and the electric power induced in the slip ring 80 is transmitted to the connector 120 through the electric wires 122.

The electric power transmitted to the connector 120 is transmitted to the electrodes 111 and 112 which are electrically connected to the connector 120 and provided in the balancer housing 110. The electric power transmitted to the electrodes 111 and 112 is transmitted to two brushes of the balancing module which are respectively in contact with the electrodes 111 and 112. The electric power transmitted to two brushes is transmitted to the control module 230 of the balancing module and the movement motor 221.

Through the above-described transmission path, the electric power generated from the slip ring disposed outside the tub may be supplied to the balancers 100 disposed inside the tub.

If the electric power is applied to each balancer 100 through the connector 120 mounted to the balancer housing at operation 401, the control module 230 of each balancer 100 detects an electric signal of the power applied to the balancer 100 through the detection unit 231 at operation 402, compares the detected electric signal with the reference electric signal within a normal range at operation 403, diagnoses a malfunction of the balancer 100 at operation 404, and outputs the malfunction signal to enable a user to be aware of the malfunction upon determining that the balancer 100 malfunctions at operation 405.

During the dehydration process in a normal state of the balancer 100, the unbalance of the rotary drum is controlled by controlling movement of the balancing module based on the amount of unbalance of the rotary drum.

In detail, based on the unbalanced force of the rotary drum detected by the unbalance detection unit 91 in the dehydration process, the control module 230 calculates resultant force of two balancing modules capable of compensating for the detected unbalanced force, determines target positions of two balancing modules, at which the calculated resultant force is generated, and respectively drives two movement motors 221 of two balancing modules so that two balancing modules may respectively move to the determined target positions.

When the movement motor 221 is driven, the control module 230 detects a rotational speed of the movement motor 221 through the speed detection unit 231*c*, and adjusts the rotational speed of the movement motor 221 using the detected speed.

If the unbalanced load of the rotary drum is counterbalanced, rotation of the wash motor 40 is accelerated to a preset rotational speed for normal dehydration.

The method of diagnosing a malfunction of the balancer 100 will be explained in more detail with reference to FIGS. 17 and 18.

FIG. 17 is a flowchart of the balancer malfunction diagnosis method based on voltage applied to the balancer.

As shown in FIG. 17, the control module 230 of the balancer detects voltage applied to the balancer through the voltage detection unit 231*a* at operation 411, and compares the detected voltage with reference voltage within a normal range to determine whether the detected voltage is less than the reference voltage at operation 412. If the detected voltage is equal to the reference voltage within a normal range, it is determined that the balancer is in a normal state.

However, if the detected voltage is less than the reference voltage, the control module 230 of the balancer determines that there is poor contact in the power supply lines, stops driving of the balancer, and transmits a malfunction signal having an error code for poor contact in the power supply lines to the main control module 90.

The poor contact in the power supply lines may include poor contact between the connector and the electrodes due to moisture, carbon dust of the brushes, spring tension, broken wires or the like, or poor contact of at least one contact point between the electrodes and the brushes.

Because poor contact in the power supply lines causes a voltage drop, whether there is poor contact in the power supply lines may be determined by comparing the detected voltage with the reference voltage. Here, the reference voltage is defined as voltage necessary to drive the balancer.

Upon receiving the malfunction signal from the control module 230 of the balancer, the main control module 90 outputs the poor contact in the power supply lines by displaying the malfunction signal through the display unit 95 at operation 413.

That is, the display unit 95 displays an error code corresponding to the malfunction signal of the balancer, thereby enabling a user to be aware of a malfunction of the balancer.

FIG. 18 is a flowchart of the balancer malfunction diagnosis method based on electric current applied to the balancer.

As shown in FIG. 18, the control module 230 of the balancer detects electric current applied to the balancer through the electric current detection unit 231*b* at operation 421, and compares the detected electric current with the first reference electric current within a normal range to determine whether the detected electric current is less than the first reference electric current at operation 422.

If the detected electric current is less than the first reference electric current, the control module 230 determines that there is poor contact in the power supply lines, and outputs the poor contact in the power supply lines at operation 423.

That is, the control module 230 stops driving of the balancer, and transmits a malfunction signal having an error code for poor contact in the power supply lines to the main control module 90 in order to inform a user of the malfunction of the balancer.

Based on a control command of the main control module 90, the display unit 95 displays a malfunction information related to poor contact in the power supply lines, thereby enabling a user to be aware of the same.

The poor contact in the power supply lines may include poor contact between the connector and the electrodes due to moisture, carbon dust of the brushes, spring tension, broken wires or the like, or poor contact of at least one contact point between the electrodes and the brushes.

If the detected electric current is greater than or equal to the first reference electric current, the control module 230 of the balancer compares the detected electric current with the second reference electric current, and the detected electric current with the third reference electric current at operation 424.

If the detected electric current is less than the second reference electric current, the control module 230 determines that the balancer is in a normal state. However, if the detected electric current is greater than or equal to the second reference electric current and less than the third reference electric current, the control module 230 determines that there is a short between two brushes, stops driving of the balancer, and outputs the malfunction of the balancer at operation 425. That is, the control module 230 transmits a malfunction signal having an error code for a short between the brushes to the main control module 90 in order to inform a user of the malfunction of the balancer.

Based on a control command of the main control module 90, the display unit 95 displays a malfunction information related to a short between the brushes, thereby enabling a user to be aware of the same.

The control module 230 determines whether the detected electric current is greater than the third reference electric current at operation 426. If the detected electric current is greater than the third reference electric current, the control module 230 determines that the movement motor malfunctions, stops driving of the balancer, and outputs the malfunction of the movement motor at operation 427. That is, the control module 230 transmits a malfunction signal having an error code for malfunction of the movement motor to the main control module 90. Based on a control command of the main control module 90, the display unit 95 displays a malfunction information related to a malfunction of the movement motor, thereby enabling a user to be aware of the same.

Here, the malfunction of the movement motor may include restriction in rotation, failure to start the movement motor or the like.

If poor contact between the connector and the electrodes or poor contact between the electrodes and the brushes occurs, a voltage drop is caused, and electric current decreases due to increase in contact resistance. Thus, the reference electric current necessary to drive the balancer becomes low.

Accordingly, in order to determine whether there is poor contact in the power supply lines, the detected electric current is compared with the first reference electric current.

If a short between two brushes of the balancing module occurs, the electric current increases above the first reference electric current necessary to drive the balancer. If driving of the movement motor is not normally performed, abnormal current greater than the first reference electric current flows through the control module 230.

Accordingly, in order to determine whether there is a short between the brushes and whether the movement motor malfunctions, the detected electric current is compared with the second reference electric current generated by occurrence of a short between the brushes and the third reference electric current generated by a malfunction of the movement motor.

As such, a short between two brushes or a malfunction of the movement motor may be diagnosed through the electric current applied to the balancer.

Although the balancer malfunction diagnosis method based on either voltage or electric current has been described above with reference to FIGS. 17 and 18, a balancer malfunction diagnosis method based on both voltage and electric current applied to the balancer may also be accomplished.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a rotary drum; and at least one balancer configured to counterbalance an unbalanced load generated in the rotary drum, wherein the at least one balancer includes:

at least one balancer housing mounted to the rotary drum; and at least one balancing module having a moving unit to move inside the at least one balancer housing, and wherein the at least one balancer housing includes:

a first electrode and a second electrode having different polarities from each other and provided at an inner surface of the at least one balancer housing in a circumferential direction of the at least one balancer housing in order to transmit electric power to the moving unit of the at least one balancing module;

at least one electric wire electrically connected to the first electrode and second electrode in order to apply the electric power from an external power source to the first electrode and the second electrode; and a connector provided at an outer surface of the at least one balancer housing in order to electrically connect the at least one electric wire and the first electrode and the second electrode.

2. The washing machine according to claim 1, wherein the connector includes a socket unit protrudingly provided at the outer surface of the at least one balancer housing, the socket unit being located at a position corresponding to positions of the first electrode and the second electrode, and a plug unit configured to be coupled to the socket unit.

3. The washing machine according to claim 2, wherein the plug unit includes a wire terminal to fix an end portion of the at least one electric wire in the plug unit.

4. The washing machine according to claim 3, wherein the socket unit includes a socket hole formed at a center portion thereof, into which the plug unit is inserted.

5. The washing machine according to claim 4, wherein the socket unit further includes an electrode terminal to electrically connect the wire terminal and the first electrode and the second electrode.

6. The washing machine according to claim 2, wherein the connector further includes a protruding part provided at the socket unit, the protruding part having a shape corresponding to a shape of the plug unit.

7. The washing machine according to claim 6, wherein the protruding part and the plug unit are coupled to each other by ultrasonic welding.

8. The washing machine according to claim 2, wherein the plug unit includes a waterproof recess which is depressed inwardly at a portion thereof.

9. The washing machine according to claim 8, wherein the waterproof recess is filled with an epoxy resin to prevent water from passing through the plug unit.

10. The washing machine according to claim 1, wherein the first electrode and the second electrode are formed by coating a conductive film on the inner surface of the at least one balancer housing.

11. The washing machine according to claim 1, further comprising:

at least one lifter protrudingly provided at an inner circumferential surface of the rotary drum.

12. The washing machine according to claim 11, wherein the at least one lifter has an end portion which is in contact with the balancer.

13. The washing machine according to claim 12, wherein the connector passes through the end portion of the at least one lifter.

14. The washing machine according to claim 13, wherein the at least one electric wire has an end portion connected to the connector, and passes through the at least one lifter.

15. A washing machine comprising:

a rotary drum in which laundry is placed, the rotary drum being capable of rotating by a driving source;

at least one balancer housing mounted to the rotary drum; and at least one lifter mounted to an inner circumferential surface of the rotary drum, wherein the at least one balancer housing includes:

a first electrode and a second electrode having different polarities from each other and provided at an inner surface of the at least one balancer housing;

electric wires electrically connected to the first electrode and the second electrode; and a connector provided at an outer surface of the at least one balancer housing in order to electrically connect the electric wires and the first electrode and the second electrode, and wherein the electric wires pass through the at least one lifter.

16. The washing machine according to claim 15, wherein the connector passes through an end portion of the at least one lifter, and is insertedly disposed in the at least one lifter.

17. The washing machine according to claim 15, further comprising:

a flange disposed at the rear portion of the rotary drum and coupled to a driving shaft which enables the rotary drum to rotate.

18. The washing machine according to claim 17, wherein the electric wires passing through the at least one lifter extend along the flange.

19. A washing machine comprising:

a rotary drum in which laundry is placed, the rotary drum being capable of rotating by a driving source;

a flange mounted to a rear surface of the rotary drum and coupled to a driving shaft which enables the rotary drum to rotate; and a balancer housing disposed at the rear portion of the flange, wherein the balancer housing includes:

a first electrode and a second electrode having different polarities from each other and provided at an inner surface of the balancer housing;

at least one electric wire electrically connected to the balancer housing; and a connector provided at an outer surface of the balancer housing in order to electrically connect the at least one electric wire and the balancer housing, and wherein the at least one electric wire includes one end portion connected to the connector, and the other end portion extending along the flange and passing through the driving shaft.

20. The washing machine according to claim 19, wherein the driving shaft is formed in a hollow cylindrical shape, through which the at least one electric wire passes.

21. A washing machine comprising:

a rotary drum;

at least one balancer to counterbalance an unbalanced load generated in the rotary drum, the at least one balancer including at least one balancer housing mounted to the rotary drum, and a balancing module having a movement motor which enables the balancing module to move inside the at least one balancer housing;

a power supply unit to supply electric power to the at least one balancer;

a detection unit to detect at least one signal of electric current and voltage of the electric power applied from the power supply unit to the at least one balancer, a control unit to determine whether intensity of the detected signal is within a normal range, and determine a malfunction of the at least one balancer upon determining that the intensity of the detected signal is outside the normal range; and wherein the at least one balancer further includes:

at least two electrodes provided at the at least one balancer housing to receive the electric power from the power supply unit, the at least two electrodes having different polarities from each other to transmit the electric power to the movement motor;

a connector to connect an external power source with the power supply unit to receive electric power from the external power source and transmit the received electric power to the power supply unit; and at least two brushes provided at the balancing module and configured to be respectively in contact with the at least two electrodes to receive the electric power from the power supply unit.

22. The washing machine according to claim 21, further comprising:

a driving unit to drive the movement motor of the balancing module, wherein the control unit stops driving of the movement motor upon determining the malfunction of the at least one balancer.

23. The washing machine according to claim 21, wherein the control unit determines whether the detected voltage is within a normal range, and determines whether there is poor contact between the connector and the at least two electrodes or poor contact of at least one contact point between the at least two electrodes and the brushes.

24. The washing machine according to claim 21, wherein the control unit determines whether the detected electric current is within a normal range, and determines whether there is poor contact between the connector and the at least two electrodes or poor contact of at least one contact point between the at least two electrodes and the brushes.

25. The washing machine according to claim 21, further comprising:

a wash motor to apply rotational force to the rotary drum; and an unbalance detection unit to detect the amount of unbalance in rotation of the wash motor, wherein the control unit controls a position and a speed of the movement motor based on the detected amount of unbalance.

26. The washing machine according to claim 25, wherein the detection unit includes a speed detection unit to detect the speed of the movement motor, and wherein the control unit adjusts the speed of the movement motor based on the detected speed.

27. The washing machine according to claim 25, wherein the power supply unit includes a slip ring in which electric current generated by rotation of the wash motor is induced.

28. The washing machine according to claim 1, wherein the at least one balancer includes a front balancer mounted to a front portion of the rotary drum and a rear balancer mounted to the rear portion of the rotary drum.

29. The washing machine according to claim 28, wherein a flange is mounted between the rear portion of the rotary tub and the rear balancer, and includes a guide part through which the at least one electric wire passes.

30. The washing machine according to claim 29, the flange is mounted to a driving shaft which enables the rotary drum to rotate.

31. The washing machine according to claim 30, wherein the driving shaft having a hollow portion therein and the guide part includes a receiving space which communicates with the hollow portion of the driving shaft and the at least one electric wire received in the hollow portion of the driving shaft passes through the receiving space of the guide part.

32. The washing machine according to claim 17, wherein the driving shaft is formed in a cylindrical shape with a hollow portion, and the at least one electric wire passes through the hollow portion of the driving shaft and the flange to connect to the at least one balancer housing.

33. The washing machine according to claim 17, wherein the flange is provided with a guide part through which the at least one electric wire passes.

* * * * *